US008187038B2

(12) United States Patent
Kamiya et al.

(10) Patent No.: US 8,187,038 B2
(45) Date of Patent: May 29, 2012

(54) CARD EDGE CONNECTOR AND METHOD OF MANUFACTURING THE SAME

(75) Inventors: Takashi Kamiya, Okazaki (JP); Taku Iida, Nagoya (JP); Yoshio Hironaka, Nukata-gun (JP); Toshihiro Miyake, Inuyama (JP); Masashi Hori, Anjo (JP)

(73) Assignee: DENSO CORPORATION, Kariya (JP)

( * ) Notice: Subject to any disclaimer, the term of this patent is extended or adjusted under 35 U.S.C. 154(b) by 42 days.

(21) Appl. No.: 12/805,224

(22) Filed: Jul. 20, 2010

(65) Prior Publication Data

US 2011/0021080 A1 Jan. 27, 2011

(30) Foreign Application Priority Data

Jul. 24, 2009 (JP) ..... 2009-173419

(51) Int. Cl.
*H01R 24/00* (2006.01)

(52) U.S. Cl. ..... 439/637

(58) Field of Classification Search ..... 439/637, 439/630, 636, 629, 157; 29/843, 874
See application file for complete search history.

(56) References Cited

U.S. PATENT DOCUMENTS 5,071,371 A 12/1991 Harwath et al.
5,112,231 A 5/1992 Harwath et al.
5,162,002 A 11/1992 Regnier
5,785,556 A 7/1998 Pratt et al.
7,628,654 B2 * 12/2009 Hori et al. ..... 439/637
2008/0188130 A1 8/2008 Buschle et al.

FOREIGN PATENT DOCUMENTS

| | | |
|---|---|---|
| JP | U-58-188995 | 12/1983 |
| JP | U-05-043489 | 6/1993 |
| JP | U-6-17170 | 3/1994 |
| JP | U-06-086366 | 12/1994 |
| JP | A-10-335019 | 12/1998 |
| JP | A-2001-230032 | 8/2001 |
| JP | A-2002-367696 | 12/2002 |

OTHER PUBLICATIONS

Office Action mailed Sep. 6, 2011 in corresponding JP application No. 2009-173419 (and English translation).

* cited by examiner

*Primary Examiner* — Alexander Gilman
(74) *Attorney, Agent, or Firm* — Posz Law Group, PLC

(57) ABSTRACT

A card edge connector for electrically connecting harnesses to contact electrodes that are located in different positions on a surface of an electronic substrate in an insertion direction includes a housing, harness terminals, and relay terminals. The housing defines a substrate insertion hole for receiving the electronic substrate. The harness terminals are separately connected to the harnesses and located in different positions in a height direction perpendicular to the insertion direction. The relay terminals separately connect the harness terminals to the contact electrodes upon insertion of the electronic substrate into the substrate insertion hole.

19 Claims, 14 Drawing Sheets

CARD EDGE CONNECTOR AND METHOD OF MANUFACTURING THE SAME

CROSS REFERENCE TO RELATED APPLICATION

This application is based on and incorporates herein by reference Japanese Patent Application No. 2009-173419 filed on Jul. 24, 2009.

FIELD OF THE INVENTION

The present invention relates to a card edge connector and a method of manufacturing the card edge connector.

BACKGROUND OF THE INVENTION

JP-U-6-86366 discloses a card edge connector in which connector terminals are located at different position's in a direction perpendicular to a surface of a board. The board is a multilayer board in which multiple substrates are stacked on top of each other. An end portion of an inner substrate of the multilayer board extends beyond an end portion of an outermost substrate of the multilayer board. Multiple terminals are arranged in each of the end portions of the inner substrate and the outermost substrate. Thus, a step having a height corresponding to a thickness of one substrate is formed between an inner card edge portion provided by the end portion of the inner substrate and an outer card edge portion provided by the end portion of the outermost card edge. The step allows the terminals to be located at different positions in the direction perpendicular to the surface of the board.

According to the card edge connector disclosed in JP-U-6-86366, the height of the step depends on the thickness of one substrate. Therefore, the height of the step may be small. In such a case, since the terminals on the inner substrate are located close to the terminals on the outermost substrate, a short-circuit may occur.

U.S. Pat. No. 7,628,654, corresponding to JP-A-2009-176625, filed by the present inventors, discloses a card edge connector in which terminals are suitably spaced in a direction vertical to a surface of an electronic board. The card edge connector disclosed in U.S. Pat. No. 7,628,654 includes a housing, a first conductive part, a second conductive part, a supporting conductive part, and a connecting element. The housing has an insertion hole for receiving an end portion of the electronic substrate therein. The electronic substrate includes a first terminal and a second terminal disposed on a surface of the end portion. The first terminal is located in front of the second terminal in an insertion direction in which the end portion of the electronic substrate is inserted into the housing. The first conductive part is disposed in the insertion hole and is configured to come in contact with the first terminal when the end portion of the electronic substrate is received by the housing. The second conductive part is disposed in the insertion hole and is configured to come in contact with the second terminal when the electronic substrate is received by the housing. The first conductive part is located at a first distance from the surface of the electronic substrate in a direction approximately vertical to the planer direction of the electronic substrate when the electronic substrate is received by the housing. The supporting conductive part is disposed in the housing and is located at a second distance from the surface of the electronic substrate in the direction approximately vertical to the planer direction of the electronic substrate when the end portion of the electronic substrate is received by the housing. The second distance is larger than the first distance. The connecting element couples the second conductive part and the supporting conductive part.

Since the second distance is larger than the first distance, the first conductive part and the supporting conductive part are suitably spaced in the direction vertical to the surface of the electronic substrate.

However, the first conductive part and the supporting conductive part have different structures, and accordingly, manufacturing cost may be increased.

SUMMARY OF THE INVENTION

In view of the above, it is an object of the present invention to provide a card edge connector manufacturable at low cost. It is another object of the present invention is to provide a method of manufacturing the card edge connector.

According to a first aspect of the present invention, a card edge connector adapted to receive an electronic substrate includes a housing, harness terminals, relay terminals, and harnesses. Contact electrodes are formed on a surface of an end portion of the electronic substrate. The contact electrodes include a first contact electrode and a second contact electrode. The first contact electrode is located in front of the second contact electrode in an insertion direction in which the end portion of the electronic substrate is adapted to be inserted into the card edge connector. The housing defines an substrate insertion hole for receiving the end portion of the electronic substrate. The harness terminals are located in the housing and include a first harness terminal and a second harness terminal. The first harness terminal is located in a first distance from the surface of the end portion of the electronic substrate in a height direction perpendicular to the surface after insertion of the end portion into the substrate insertion hole. The second harness terminal is located in a second distance from the surface of the end portion in the height direction after insertion of the end portion into the substrate insertion hole, the second distance greater than the first distance. The relay terminals located in the housing. Each relay terminal has a first end in contact with a corresponding harness terminal and a second end in contact with a corresponding contact electrode after insertion of the end portion into the substrate insertion hole. The relay terminals include a first relay terminal and a second relay terminal. The first relay terminal electrically connects the first harness terminal to one of the first contact electrode and the second contact electrode after insertion of the end portion into the substrate insertion hole. The second relay terminal electrically connects the second harness terminal to the other of the first contact electrode and the second contact electrode after insertion of the end portion into the substrate insertion hole. Each harness has a first end connected to a corresponding harness terminal and a second end exposed outside the housing. The harnesses include a first harness connected to the first harness terminal and a second harness connected to the second harness terminal.

According to a second aspect of the present invention, a method of manufacturing the card edge connector includes preparing the housing. The housing is formed by resin injection molding so as to have the substrate insertion hole on a housing surface, harness terminal holes, and relay terminal holes. Each relay terminal hole extends from the housing surface to a corresponding harness terminal hole. The method further includes inserting the first end of each relay terminal into a corresponding relay terminal hole in such a manner that the first end of each relay terminal is partially located in the corresponding harness terminal, a middle part between the first end and the second end of each relay terminal is located on the housing surface, and the second end of each relay terminal projects into the substrate insertion hole. The method further includes inserting each harness terminal into the corresponding harness terminal hole.

According to a third aspect of the present invention, a method of manufacturing the card edge connector includes preparing the housing. The housing is formed by resin injection molding so as to have the substrate insertion hole, harness terminal holes, and the relay terminals that are insert-molded. The method further includes inserting each harness terminal into a corresponding harness terminal hole.

BRIEF DESCRIPTION OF THE DRAWINGS

The above and other objectives, features and advantages of the present invention will become more apparent from the following detailed description made with check to the accompanying drawings. In the drawings.

DETAILED DESCRIPTION OF THE PREFERRED EMBODIMENTS

Figure 1:
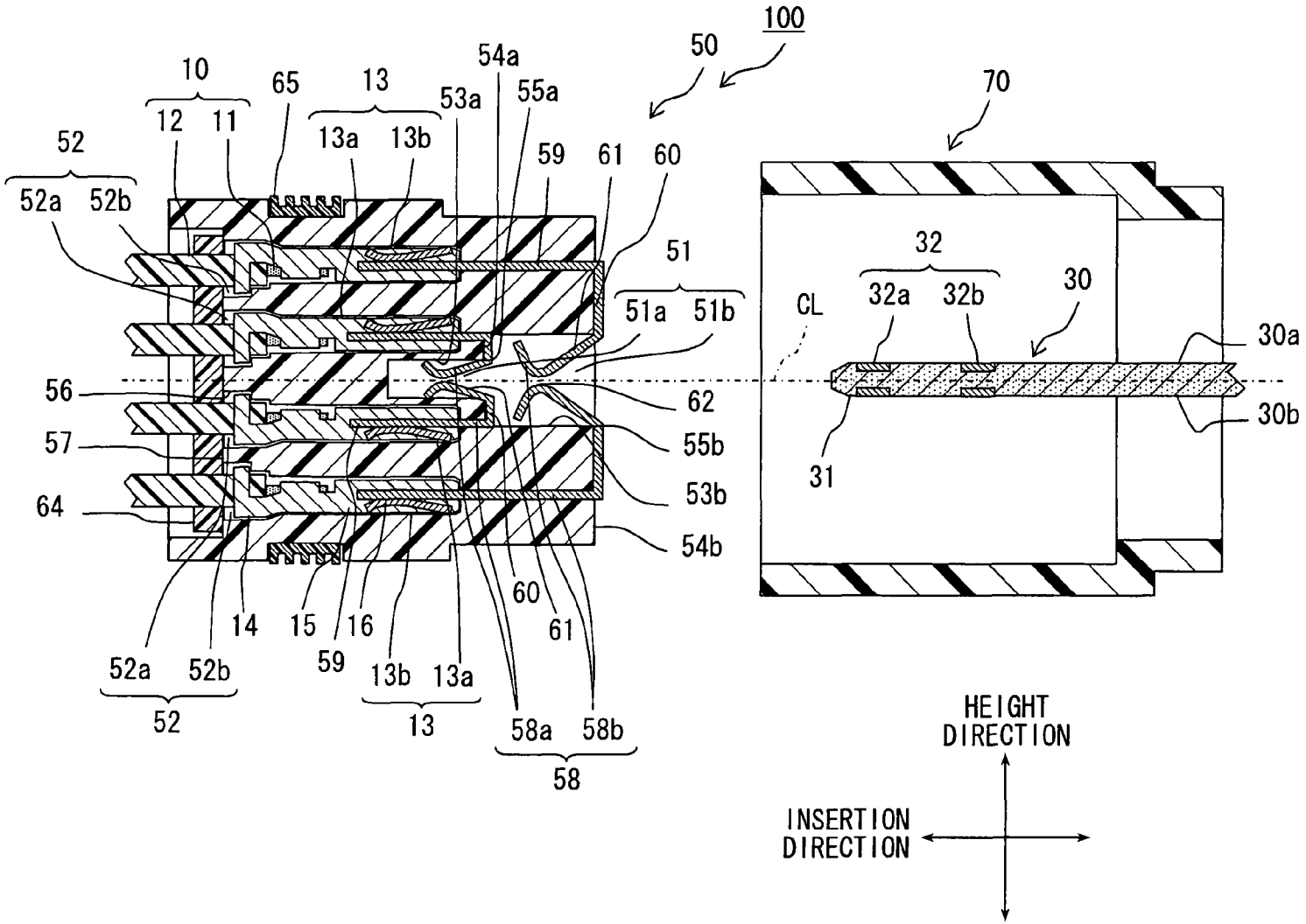
FIG. 1 is a diagram illustrating an exploded view of a card edge connector according to a first embodiment of the present invention.

Embodiments of the present invention are described below with reference to the drawings.

(First Embodiment)

A card edge connector 100 according to a first embodiment of the present invention is described below with reference to FIGS. 1-5B. The card edge connector 100 includes a terminal 13 and a housing 50. The terminal 13 is connected to an end of a harness 10. The housing 50 holds the harness 10 and an electronic substrate 30 so that the harness 10 and the electronic substrate 30 can be electrically connected together. According to the first embodiment, the electronic substrate 30 is accommodated in a casing 70, and the casing 70 is assembled with the housing 50, i.e., the card edge connector 100.

The harness 10 includes a metal wire 11 and a cover 12 for covering the metal wire 11. As shown in FIG. 1, the terminal 13 is electrically and mechanically connected to the end of the harness 10 and electrically connected to a contact electrode 32 of the electronic substrate 30 through a relay terminal 58, which is described later.

The terminal 13 has a first terminal 13*a* and a second terminal 13*b*. The first terminal 13*a* is located at a first distance from a front surface 30*a* (or a back surface 30*b*) of the electronic substrate 30 in a height direction. The second terminal 13*b* is located at a second distance from the front surface 30*a* (or the back surface 30*b*) of the electronic substrate 30 in the height direction. The second distance is greater than the first distance so that the second terminal 13*b* can be located farther away from the front surface 30*a* (or the back surface 30*b*) of the electronic substrate 30 than the first terminal 13*a* in the height direction. Each of the first terminal 13*a* and the second terminal 13*b* is configured as a female terminal and includes a crimp portion 14, a tubular body (i.e., sleeve) portion 15 extending from the crimp portion 14, and a contact portion 16 located inside the body portion 15. The crimp portion 14 is crimped so that the crimp portion 14 can be joined to the cover 12 of the harness 10. The contact portion 16 is elastically deformable. When the relay terminal 58 is inserted in the body portion 15, the contact portion 16 is elastically deformed and comes in contact with the relay terminal 58 at a predetermined contact pressure so that the contact portion 16 and the relay terminal 58 can be electrically connected together. Further, the body portion 15 is crimped so that the body portion 15 can be electrically and mechanically connected to the metal wire 11 of the harness 10.

Figure 2:
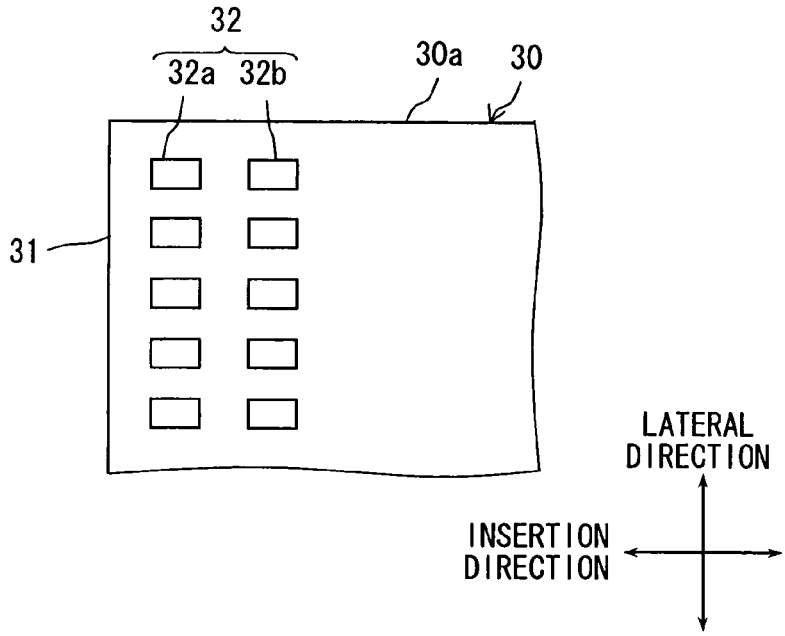
FIG. 2 is a diagram illustrating a plan view for explaining a layout of a contact electrode on an electronic substrate.

The electronic substrate 30 includes electronic devices (not shown) and a pattern of conductive traces (not shown) electrically connected to the electronic devices. As shown in FIG. 2, the contact electrode 32 is formed on both the front surface 30*a* and the back surface 30*b* of an end portion 31 of the electronic substrate 30. The contact electrode 32 serves as an end terminal of the pattern of conductive traces. The end portion 31 of the electronic substrate 30 is inserted in the housing 50. The contact electrode 32 has a first contact electrode 32*a* and a second contact electrode 32*b*. The first contact electrode 32*a* is located at a third distance from a tip of the end portion 31 of the electronic substrate 30 in an insertion direction. The second contact electrode 32*b* is located at a fourth distance from the tip of the end portion 31 of the electronic substrate 30 in the insertion direction. The third distance is smaller than the fourth distance so that the first contact electrode 32*a* can be located in front of the second contact electrode 32*b* in the insertion direction. Each of the first and second contact electrodes 32*a*, 32*b* has a rectangular shape with a long side in the insertion direction. In such an approach, a contact area between the contact electrode 32 and the relay terminal 58 is increased in the insertion direction.

Multiple first contact electrodes 32*a* are arranged on both of the front and back surfaces 30*a*, 30*b* of the electronic substrate 30 at predetermined intervals in a lateral direction perpendicular to the insertion direction. Likewise, multiple second contact electrodes 32*b* are arranged on both of the front and back surfaces 30*a*, 30*b* of the electronic substrate 30 at substantially the same intervals as the first contact electrodes 32*a* in the lateral direction. Thus, the first contact electrode 32*a* and the second contact electrode 32*b* are aligned with each other in the insertion direction. Further, the first contact electrode 32*a* on the front surface 30*a* is located directly opposite the first contact electrode 32*a* on the back surface 30*b* across the electrode substrate 30. Likewise, the second contact electrode 32*b* on the front surface 30*a* is located directly opposite the second contact electrode 32*b* on the back surface 30*b* across the electronic substrate 30. That is, the contact electrode 32 on one surface of the electrode substrate 30 is located directly below or above the contact electrode 32 on the other surface of the electronic substrate 30 in the height direction.

The housing 50 electrically connects the terminal 13 and the contact electrode 32 through the relay terminal 58 while holding the harness 10 and the electronic substrate 30. The housing 50 is formed by resin injection molding. The housing 50 has a substrate insertion hole 51 for receiving the electronic substrate 30 and a terminal insertion hole 52 for receiving the terminal 13 of the harness 10. The relay terminal 58 for electrically connecting the terminal 13 and the contact electrode 32 is formed to the housing 50 in such a manner that a first end of the relay terminal 58 projects into the substrate insertion hole 51 and that a second end of the relay terminal 58 projects into the terminal insertion hole 52.

As shown in FIG. 1, the substrate insertion hole 51 includes a first insertion hole 51*a* for receiving the first contact electrode 32*a* of the electronic substrate 30 and a second insertion hole 51*b* for receiving the second contact electrode 32*b* of the electronic substrate 30. The first insertion hole 51*a* is defined by a first inner wall 53*a* of the housing 50. The second insertion hole 51*b* is defined by a second inner wall 53*b* of the housing 50. Each of the first and second inner walls 53*a*, 53*b* has a top surface and a bottom surface.

The first and second inner walls 53*a*, 53*b* are connected together through a first housing surface 54*a* of the housing 50. The first housing surface 54*a* is substantially perpendicular to the insertion direction and recessed in the insertion direction to form the first insertion hole 51*a*. The first inner wall 53*a* and the first housing surface 54*a* form a corner portion 55*a*. As described later, the corner portion 55*a* comes in contact with a joint portion between a connecting portion 60 and an electrode contact portion 61 of a first relay terminal 58*a*.

A second housing surface 54*b* of the housing 50 is connected to the second inner wall 53*b*. The second housing surface 54*b* is substantially perpendicular to the insertion direction and recessed in the insertion direction to form the second insertion hole 51*b*. The second inner wall 53*b* and the second housing surface 54*b* form a corner portion 55*b*. As described later, the corner portion 55*b* comes in contact with a joint portion between a connecting portion 60 and an electrode contact portion 61 of a second relay terminal 58*b*.

A distance between the front surface 30*a* of the electronic substrate 30 and the top surface of the first inner wall 53*a* is equal to a distance between the back surface 30*b* of the electronic substrate 30 and the bottom surface of the first inner wall 53*a*. Likewise, a distance between the front surface 30*a* of the electronic substrate 30 and the top surface of the second inner wall 53*b* is equal to a distance between the back surface 30*b* of the electronic substrate 30 and the bottom surface of the second inner wall 53*b*. The second inner wall 53*b* and the first housing surface 54*a* form a substantially right-angle corner.

As shown in FIG. 1, the terminal insertion hole 52 has a first terminal insertion hole 52*a* and a second terminal insertion hole 52*b*. The first terminal insertion hole 52*a* is located at a fifth distance from the front surface 30*a* (or the back surface 30*b*) of the electronic substrate 30 in the height direction. The second terminal insertion hole 52*b* is located at a sixth distance from the front surface 30*a* (or the back surface 30*b*) of the electronic substrate 30 in the height direction. The sixth distance is greater than the fifth distance so that the second terminal insertion hole 52*b* can be located farther away from the front surface 30*a* (or the back surface 30*b*) of the electronic substrate 30 than the first terminal insertion hole 52*a* in the height direction. The first terminal 13*a* is inserted in the first terminal insertion hole 52*a*. The second-terminal 13*b* is inserted in the second terminal insertion hole 52*b*. A third inner wall 56 and a bottom surface 57 of the housing 50 define the terminal insertion hole 52. The third inner wall 56 has a projection (not shown) received by a hole (not shown) of the body portion 15 of the terminal 13. A sealing member 64 is located on the bottom surface 57 to seal a clearance between the harness 10 and the housing 50.

The relay terminal 58 can be formed by stamping and bending a metal sheet or plate. The relay terminal 58 includes the first relay terminal 58*a* and the second relay terminal 58*b*. The first relay terminal 58*a* is configured to electrically connect the first terminal 13*a* to the first contact electrodes 32*a* on both surfaces 30*a*, 30*b* of the electronic substrate 30. The second relay terminal 58*b* is configured to electrically connect the second terminal 13*b* to the second contact electrodes 32*b* on both surfaces 30*a*, 30*b* of the electronic substrate 30.

Each of the first relay terminal 58*a* and the second relay terminal 58*b* includes a terminal contact portion 59, a connecting portion 60, and an electrode contact portion 61.

In the first relay terminal 58*a*, the terminal contact portion 59 extends through the housing 50 from the first terminal 13*a* (i.e., first terminal insertion hole 52*a*) to the first housing surface 54*a* and is joined to the connecting portion 60. The connecting portion 60 extends to the corner portion 55*a* along the first housing surface 54*a* and is joined to the electrode contact portion 61. The electrode contact portion 61 projects into the first insertion hole 51*a*.

In the second relay terminal 58*b*, the terminal contact portion 59 extends through the housing 50 from the second terminal 13*b* (i.e., second terminal insertion hole 52*b*) to the second housing surface 54*b* and is joined to the connecting portion 60. The connecting portion 60 extends to the corner portion 55*b* along the second housing surface 54*b* and is joined to the electrode contact portion 61. The electrode contact portion 61 projects into the second insertion hole 51*b*.

As can be seen from FIG. 1, the terminal contact portion 59 and the connecting portion 60 are joined together substantially at a right angle so as to form a L-shape. An end of the terminal contact portion 59 on the terminal insertion hole 52 side is inserted in the body portion 15 of the terminal 13 and is electrically connected to the contact portion 16 by coming in contact with the contact portion 16.

The connecting portion 60 and the electrode contact portion 61 are joined together at an obtuse angle so as to form a V-shape with an obtuse angle. An end of the electrode contact portion 61 of the first relay terminal 58*a* projecting into the first insertion hole 51*a* is electrically connected to the first contact electrode 32*a* by coming in contact with the first contact electrode 32*a*. An end of the electrode contact portion 61 of the second relay terminal 58*b* projecting into the second insertion hole 51*b* is electrically connected to the second contact electrode 32*b* by coming in contact with the second contact electrode 32*b*.

When the electronic substrate 30 is inserted into the substrate insertion hole 51 of the housing 50, the electrode contact portion 61 is pressed by the electronic substrate 30 so that the obtuse angle between the connecting portion 60 and the electrode contact portion 61 approaches a right angle. Further, the electrode contact portion 61 is elastically deformed due to the pressure from the electronic substrate 30 so that the electrode contact portion 61 can remain in contact with the contact electrode 32 at a predetermined contact pressure. As shown in FIG. 1, the electrode contact portions 61 projecting into the insertion holes 51*a*, 51*b* are curved to be convex with respect to a center line CL along which the electronic substrate 30 is inserted into the substrate insertion hole 51. It is noted that the center line CL represents the center of the electronic substrate 30 in the height direction and is the same distance from each of the front surface 30*a* and the back surface 30*b*. Thus, when the electronic substrate 30 is inserted into the substrate insertion hole 51, vertex 62 of the convex electrode contact portions 61 come in contact with the contact electrodes 32 of the electronic substrate 30. According to the first embodiment, vertex 62 of the convex electrode contact portions 61 of two first relay terminals 58*a* are located opposite each other, and vertex 62 of the convex electrode contact portions 61 of two second relay terminals 58*b* are located opposite each other.

Figure 3A:
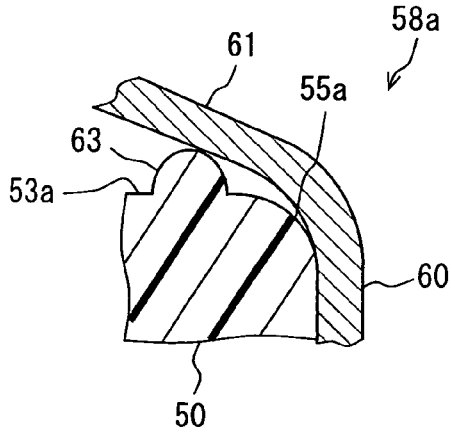
FIG. 3A is a diagram illustrating an enlarged cross-sectional view of a projection for supporting a first relay terminal.
Figure 3B:
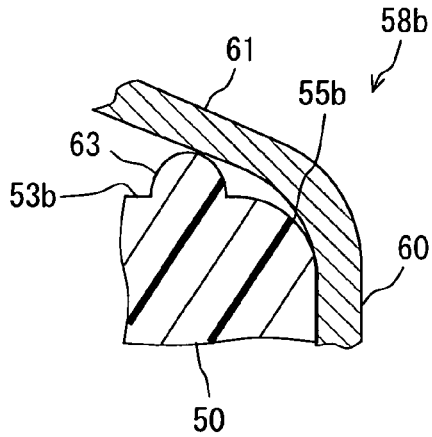
FIG. 3B is a diagram illustrating an enlarged cross-sectional view of a projection for supporting a second relay terminal.

As shown in FIG. 3A, a junction between the connecting portion 60 and the electrode contact portion 61 of the first relay terminal 58*a* is in contact with the corner portion 55*a*. As shown in FIG. 3B, a junction between the connecting portion 60 and the electrode contact portion 61 of the second relay terminal 58*b* is in contact with the corner portion 55*b*. Each of the first and second inner walls 53*a*, 53*b* has a projection 63. The projection 63 supports the electrode contact portion 61 when the electronic substrate 30 is inserted into the substrate insertion hole 51, so that the angle of the junction between the connecting portion 60 and the electrode contact portion 61 can be kept constant. When the electrode contact portion 61 is pressed by the electronic substrate 30 during insertion of the electronic substrate 30 in the substrate insertion hole 51, the electrode contact portion 61 is deformed in the insertion direction, with the point of load at a contact point between the electrode contact portion 61 and the electrode substrate 30 and with the fulcrum at a contact point between the projection 63 and a straight part of the electrode contact portion 61. That is, the fulcrum, with which the electrode contact portion 61 is deformed in the insertion direction, is not at a contact point between the corner portion 55 and the junction between the connecting portion 60 and the electrode contact portion 61.

As shown in FIGS. 3A, 3B, at the micro level, the corner portion 55 is rounded. Therefore, if the electrode contact portion 61 is deformed with the fulcrum at the contact point between the corner portion 55 and the junction between the connecting portion 60 and the electrode contact portion 61, the contact point may vary. As a result, the angle of the junction between the connecting portion 60 and the electrode contact portion 61 may vary. Accordingly, the contact pressure, at which the electrode contact portion 61 is in contact with the contact electrode 32, may vary.

In contrast, according to the first embodiment, the fulcrum, with which the electrode contact portion 61 is deformed, can be fixed at the contact point between the projection 63 and the straight part of the electrode contact portion 61. Thus, the angle of the junction between the connecting portion 60 and the electrode contact portion 61 can be kept constant so that the contact pressure, at which the electrode contact portion 61 is in contact with the contact electrode 32, can be kept constant.

The casing 70 has a hollow box shape with an opening and a bottom. Guide slots (not shown) for guiding and the electronic substrate 30 to a predetermined position in the casing 70 are formed on an inner side surface and an inner bottom surface of the casing 70. Further, a supporting portion (not shown) for supporting the electronic substrate 30 is formed on the bottom surface of the casing 70. The electronic substrate 30 is inserted in the casing 70 from the opening along the guiding slots so that the electronic substrate 30 can be supported by the casing 70. When the housing 50 is inserted in the casing 70, the housing 50 is fitted with the casing 70 so that the electronic substrate 30 can be sealed in a space defined by the housing 50 and the casing 70.

Figure 4:
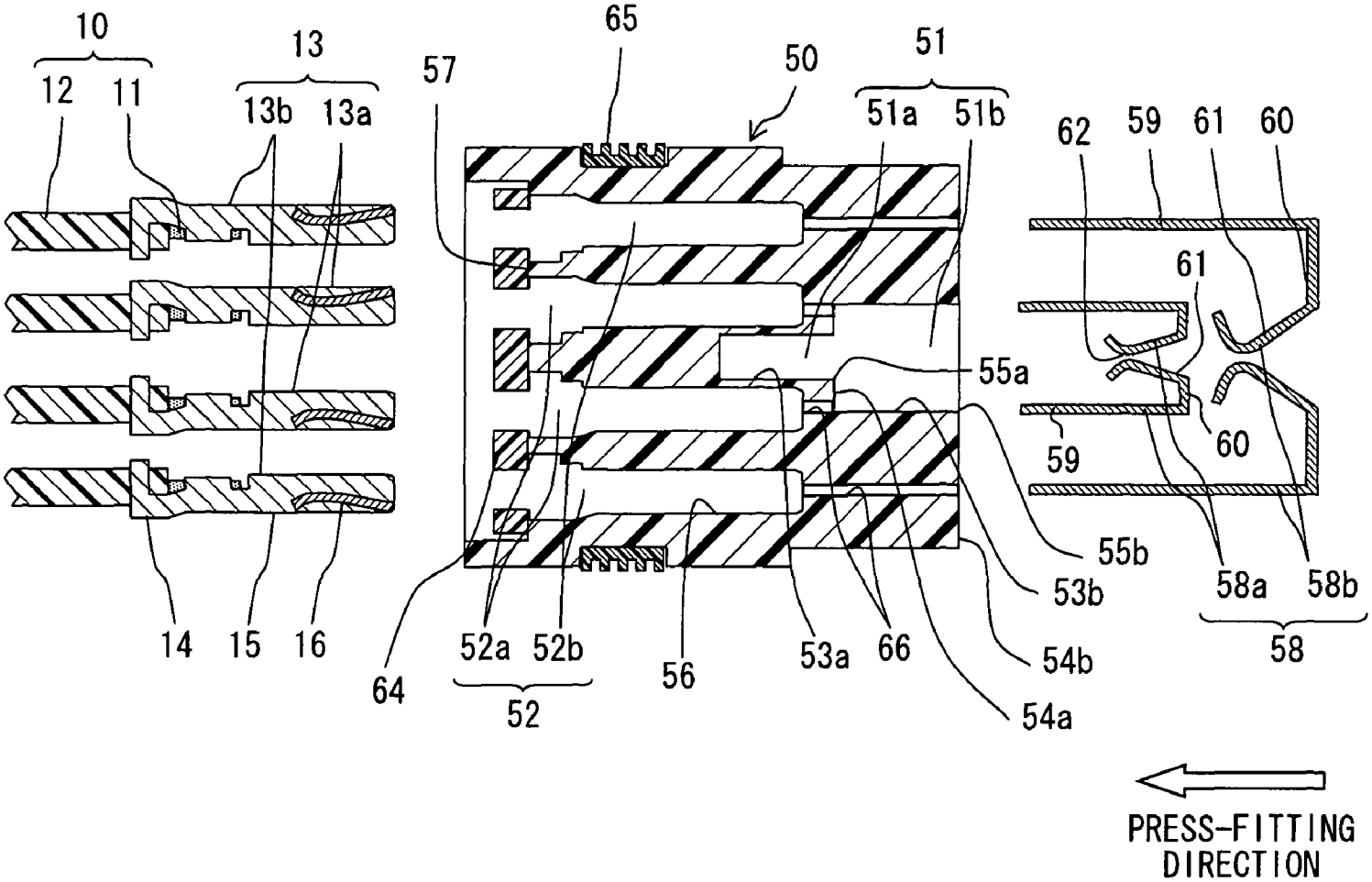
FIG. 4 is a diagram illustrating a cross-sectional view for explaining a method of manufacturing the card edge connector.

When the card edge connector 100 is used in a vehicle, it is preferable that the card edge connector 100 should have a waterproof structure that prevents water from entering the card edge connector 100. For this reason, according to the first embodiment, the card edge connector 100 is waterproofed by the sealing member 64 that seals the clearance between the harness 10 and the housing 50. As shown in FIG. 4, the sealing member 64 has through holes through which the terminal insertion holes 52 are exposed to the outside of the housing 50. The terminals 13 are inserted in the terminal insertion holes 52 by passing through the through holes of the sealing member 64 so that the sealing member 64 can be located around the harnesses 10. In this way, the clearance between the harness 10 and the housing 50 is sealed by the sealing member 64 so that entry of water into the terminal insertion hole 52 can be prevented. Further, a sealing member 65 is formed around the perimeter of the housing 50 so that a clearance between the housing 50 and the casing 70 can be sealed by the sealing member 65. Thus, the sealing member 65 prevents water from entering the space where the electronic substrate 30 is located.

Next, a method of manufacturing the card edge connector 100 according to the first embodiment is described below with reference to FIG. 4. Firstly, the harness 10, the housing 50, the relay terminal 58, and the casing 70 in which the electronic substrate 30 is already inserted are prepared. Then, a press-fitting process is performed to attach the relay terminal 58 to the housing 50 by press-fitting the terminal contact portion 59 into a narrow hole 66 of the housing 50. The narrow hole 66 extends from each of the first and second housing surfaces 54*a*, 54*b* to the terminal insertion hole 52. It is noted that the narrow hole 66 for the first relay terminal 58*a* is located at the substantially right-angle corner formed by the second inner wall 53*b* and the first housing surface 54*a*. The first relay terminal 58*a* is press-fitted into the narrow hole 66 located at the substantially right-angle corner so that the first and second relay terminals 58*a*, 58*b* can be arranged in the insertion direction without being in contact with each other.

Figure 5A:
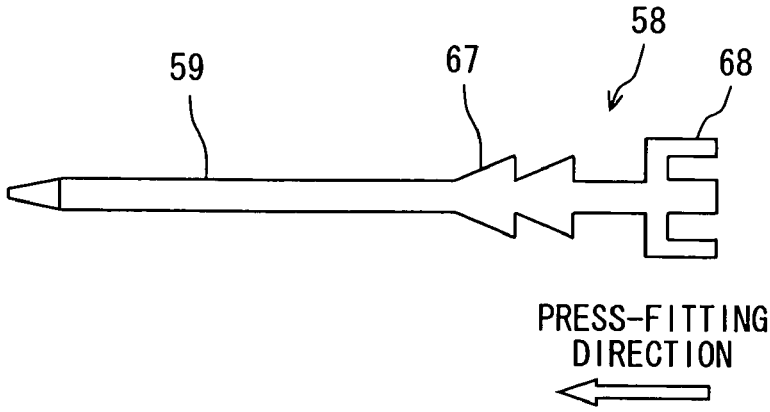
FIG. 5A is a diagram illustrating a plan view of a relay terminal.
Figure 5B:
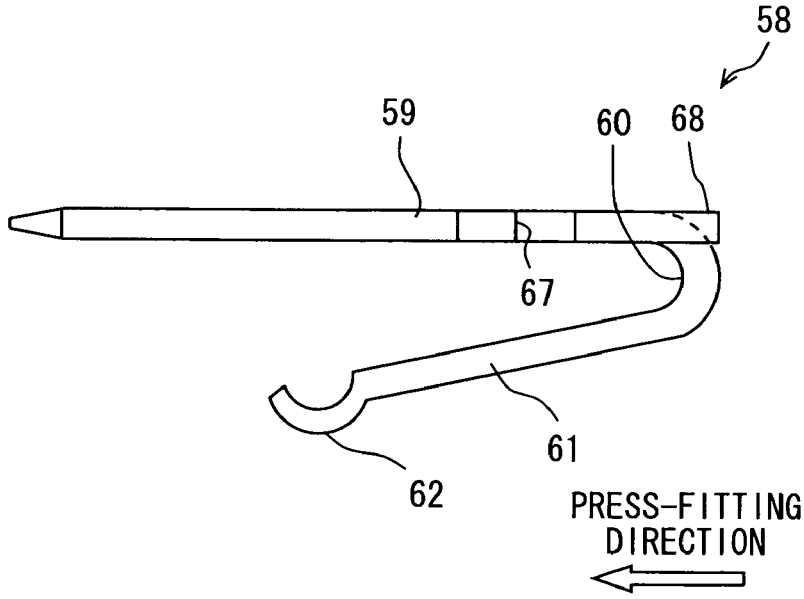
FIG. 5B is a diagram illustrating a side view of the relay terminal.

As shown in FIGS. 5A and 5B, the terminal contact portion 59 has a pointed (i.e., sharpened) tip on one end. Therefore, a resistance applied by the housing 50 to the terminal contact portion 59 during the press-fitting process is reduced so that the terminal contact portion 59 can be easily press-fitted into the narrow hole 66. Further, the terminal contact portion 59 has a tab 68 on the other end. The terminal contact portion 59 can be easily press-fitted into the narrow hole 66 by applying force to the tab 68. In this way, the pointed tip and the tab 68 facilitate press-fitting of the terminal contact portion 59 into the narrow hole 66. Furthermore, the terminal contact portion 59 has a tapered barb 67 between the ends. When the terminal contact portion 59 is completely press-fitted into the narrow hole 66, the tapered barb 67 is fitted with a corresponding projection on an inner surface of the narrow hole 66 so that the terminal contact portion 59 can be surely attached to the housing 50. Thus, electrical connection between the terminal contact portion 59 and the contact portion 16 can be ensured, and electrical connection between electrode contact portion 61 and the contact electrode 32 can be ensured. It is noted that when the terminal contact portion 59 is completely press-fitted into the narrow hole 66, one end (i.e., pointed end side) of the terminal contact portion 59 projects into the terminal insertion hole 52.

After the press-fitting process is finished, a removing process is performed to remove the tab 68.

After the removing process is finished, a first insertion process is performed to insert the terminal 13 connected to the harness 10 into the terminal insertion hole 52 through the sealing member 64. Specifically, in the first insertion process, the entire terminal 13 passes through the through hole of the sealing member 64 so that the sealing member 64 can be located around the harness 10. Thus, the clearance between the harness 10 and the housing 50 can be sealed by the sealing member 64. It is noted that a tip surface of the body portion 15 of the terminal 13 has an opening. Therefore, when the terminal 13 is completely inserted into the terminal insertion hole 52, the end of the terminal contact portion 59 of the relay terminal 58 attached to the housing 50 is inserted into the body portion 15 of the terminal 13 through the opening so that the terminal contact portion 59 can come in contact with the contact portion 16 that is located inside the body portion 15.

After the first insertion process is finished, a second insertion process is performed to insert the electronic substrate 30 into the substrate insertion hole 51. Specifically, in the second insertion process, the electronic substrate 30 is inserted into the substrate insertion hole 51 against elastic force from the relay terminal 58 (i.e., electrode contact portion 61). As a result, the electronic substrate 30 is sandwiched between the relay terminal 58 in contact with the contact electrode 32 on the front surface 30*a* and the relay terminal 58 in contact with the contact electrode 32 on the back surface 30*b*, so that the electronic substrate 30 can be held in the substrate insertion hole 51. Along with insertion of the electronic substrate 30 into the substrate insertion hole 51, the housing 50 is inserted into and fitted with the casing 70 so that the ring-shaped sealing member 65 can be located between the housing 50 and the casing 70. Thus, the space, where the electronic substrate 30 is located, is hermetically sealed by the housing 50, the casing 70, and the ring-shaped sealing member 65.

In this way, the card edge connector 100 according to the first embodiment is manufactured by performing the press-fitting process, the removing process, the first insertion process, and the second insertion process.

In the above-described method, the relay terminal 80 is attached to the housing 50 by the press-fitting process, in which the terminal contact portion 59 is press-fitted into the narrow hole 66. Alternatively, the relay terminal 58 can be attached to the housing 50 by insert molding. In such an approach, the press-fitting process and the removing process are omitted so that the manufacturing processes of the card edge connector 100 can be simplified. Even when the relay terminal 58 is attached to the housing 50 by insert molding, it is preferable that the terminal contact portion 59 have the tapered barb 67 to reinforce the attachment of the relay terminal 58 to the housing 50.

In the above-described method, the removing process is performed after the press-fitting process. Alternatively, the removing process can be performed after the first insertion process.

In the above-described method, the second insertion process is performed after the first insertion process. Alternatively, the second insertion process can be performed before the first insertion process.

As described above, according to the first embodiment, the terminal 13 has the first terminal 13*a* and the second terminal 13*b* that is located farther away from the electronic substrate 30 than the first terminal 13*a* in the height direction. Further, the contact electrode 32 has the first contact electrode 32*a* and the second contact electrode 32*b* that is located farther away from the tip of the end portion 31 of the electronic substrate 30 than the first contact electrode 32*a* in the insertion direction. In this way, according to the card edge connector 100, the first terminal 13*a* and the second terminal 13*b* are located at different positions in the height direction to form enough clearance to prevent a short-circuit.

Each of the first terminal 13*a* and the second terminal 13*b* has the same structure and is configured as a female terminal. The first and second terminals 13*a*, 13*b* are electrically connected to the first and second contact electrodes 32*a*, 32*b* through the relay terminals 58*a*, 58*b*, respectively, after insertion of the electronic substrate 30 into the substrate insertion hole 51 of the housing 50. Since the terminal 13 has the same structure, manufacturing cost of the terminal 13 can be reduced. Further, since the terminal 13 has the same structure, each harness 10 has the same structure so that manufacturing cost of the harness 10 can be reduced. Thus, manufacturing cost of the card edge connector 100 as a whole can be reduced.

The terminal 13 is configured as a female terminal in which the contact portion 16 is located in the body portion 15. Since the contact portion 16 is located in the body portion 15, the terminal 13 can be easily inserted into the terminal insertion hole 52.

The contact electrode 32 is formed on both surfaces 30*a*, 30*b* of the electronic substrate 30. In such an approach, the number of signal lines of the card edge connector 100 can be increased.

The contact electrode 32 has the rectangular shape with the long side in the insertion direction. In such an approach, the contact area between the contact electrode 32 and the relay terminal 58 is increased in the insertion direction so that electrical connection between the contact electrode 32 and the relay terminal 58 can be ensured.

(Second Embodiment)

Figure 6:
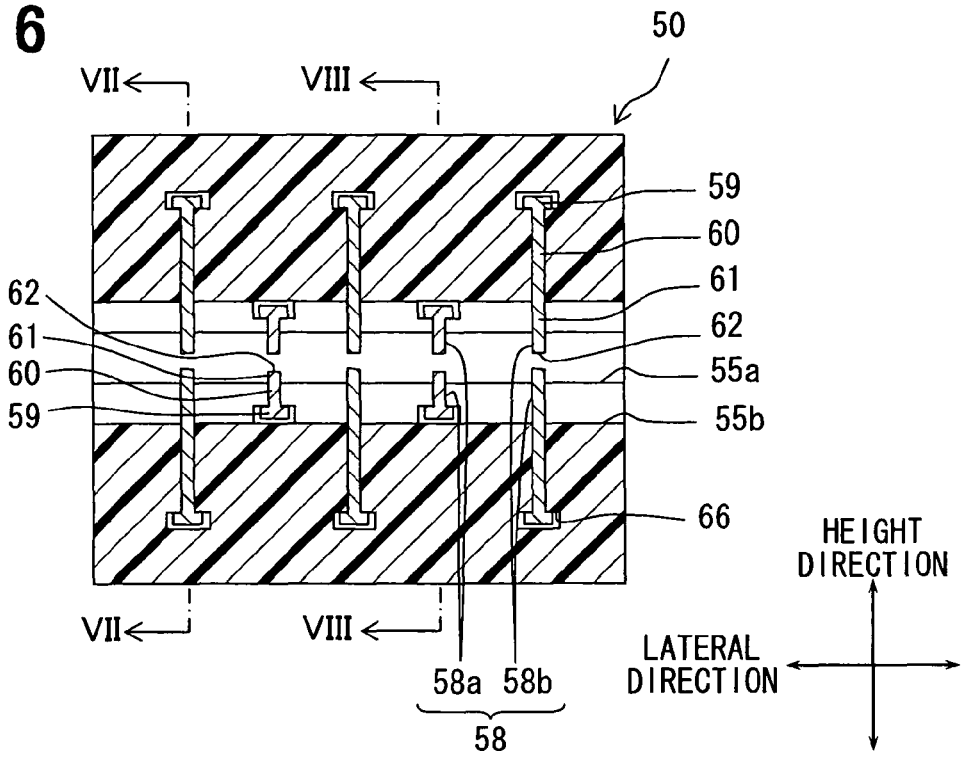
FIG. 6 is diagram illustrating a cross-sectional view for explaining a layout of a relay terminal in a housing 50 of a card edge connector according to a second embodiment of the present invention.
Figure 7:
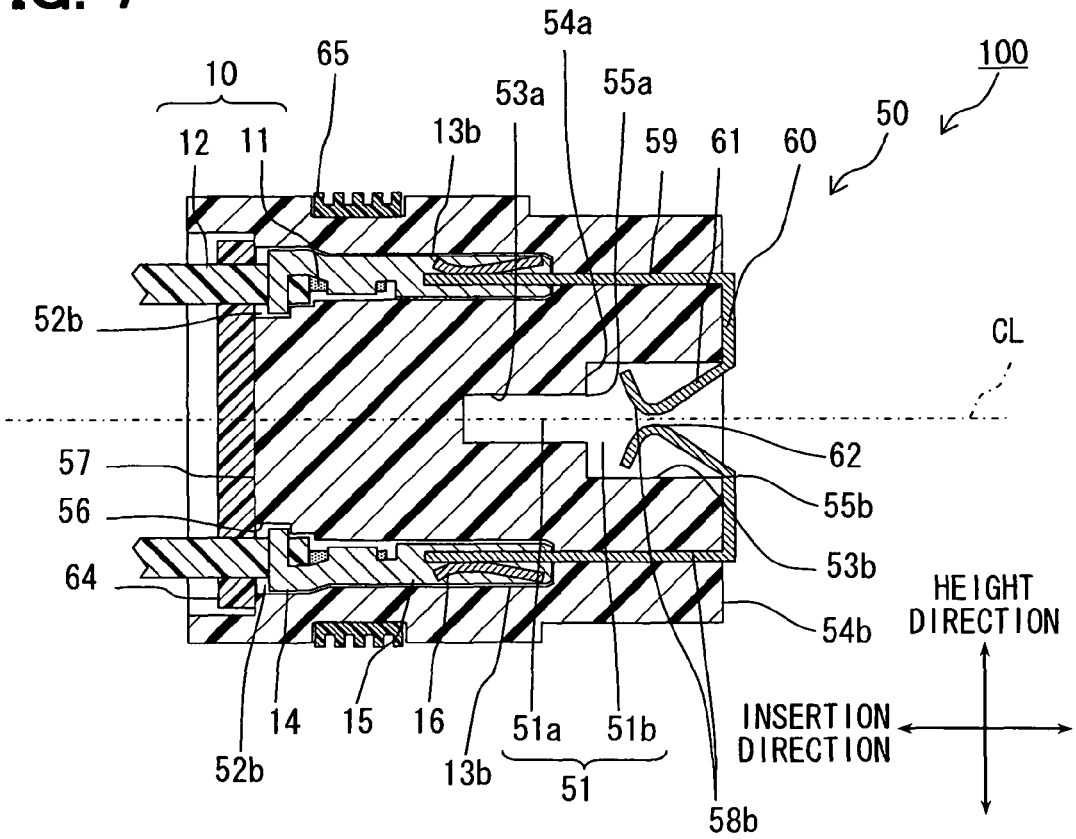
FIG. 7 is a diagram illustrating a cross-sectional view taken along the line VII-VII in FIG. 6.
Figure 8:
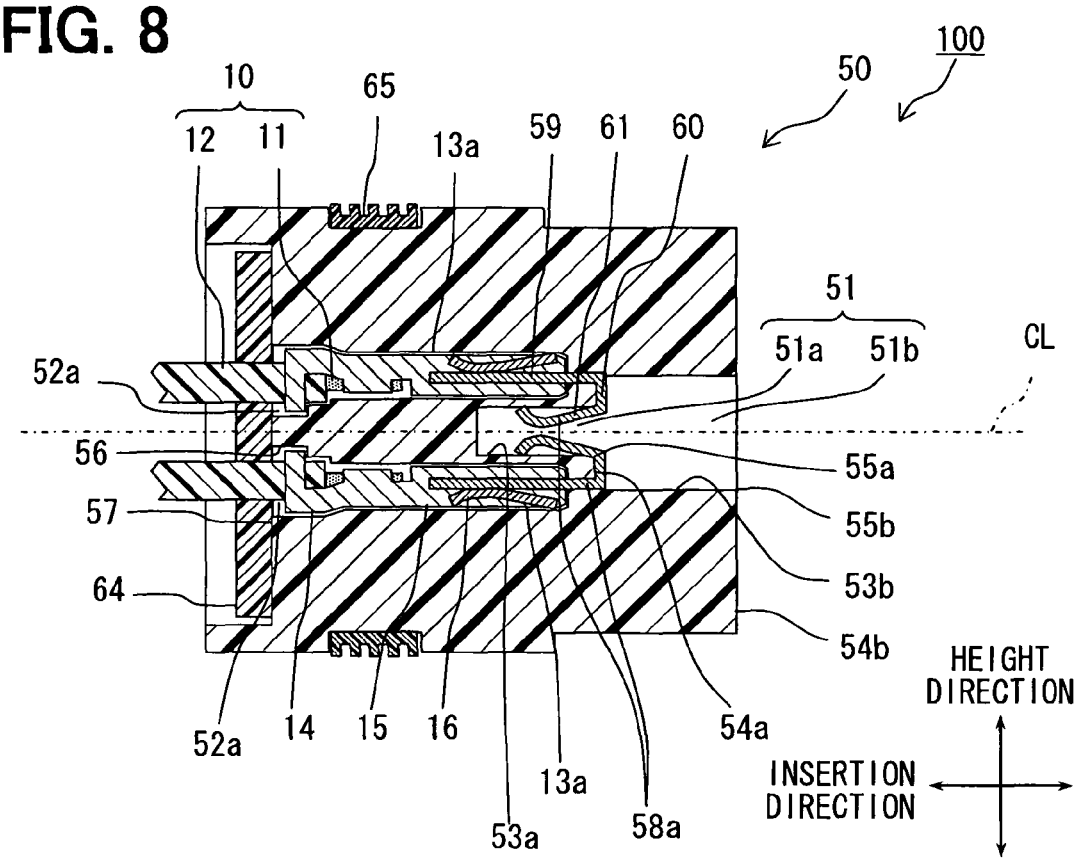
FIG. 8 is a diagram illustrating a cross-sectional view taken along the line VIII-VIII in FIG. 6.
Figure 9:
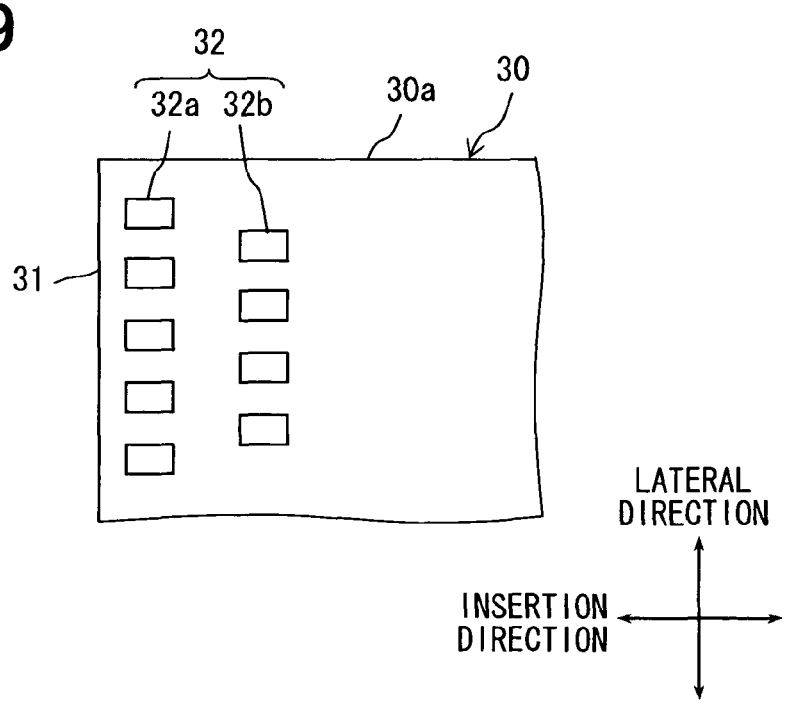
FIG. 9 is a diagram illustrating a plan view for explaining a layout of a contact electrode on an electronic substrate of a card edge connector according to the second embodiment.

A card edge connector 100 according to the second embodiment of the present invention is described below with reference to FIGS. 6-9. FIG. 6 is a cross-sectional view for explaining a layout of the relay terminal 58 in the housing 50. FIG. 7 is a cross-sectional view taken along the line VII-VII in FIG. 6. FIG. 8 is a cross-sectional view taken along the line VIII-VIII in FIG. 6. FIG. 9 is a plan view for explaining a layout of the contact electrode 32 on the electronic substrate 30. A difference of the second embodiment from the first embodiment is as follows.

Referring back to FIG. 1, according to the first embodiment, the first relay terminal 58*a* and the second relay terminal 58*b* are aligned with each other in the height direction in the housing 50. In contrast, according to the second embodiment, as can be seen from FIGS. 6-8, the first relay terminal 58*a* and the second relay terminal 58*b* are not aligned with each other in the height direction in the housing 50. Specifically, the first relay terminal 58*a* and the second relay terminal 58*b* are alternately arranged at predetermined intervals in the lateral direction. Accordingly, the first terminal 13*a* and the second terminal 13*b*, which are located in different positions in the height direction, are alternately arranged in the lateral direction in the housing 50.

Further, according to the second embodiment, as shown in FIG. 9, the first contact electrode 32*a* and the second contact electrode 32*b* are not aligned with each other in the insertion direction. Specifically, the first contact electrode 32*a* and the second contact electrode 32*b* are alternately arranged in the lateral direction. Adjacent first contact electrodes 32*a* are spaced from each other in the lateral direction by a predetermined distance that allows the electrode contact portion 61 of the second relay terminal 58*b* to come in contact with the second contact electrode 32*b* without coming in contact with the first contact electrode 32*a* during insertion of the electronic substrate 30 into the substrate insertion hole 51.

Like the first embodiment, the first contact electrode 32*a* on the front surface 30*a* is located directly opposite the first contact electrode 32*a* on the back surface 30*b* across the electrode substrate 30, and the second contact electrode 32*b* on the front surface 30*a* is located directly opposite the second contact electrode 32*b* on the back surface 30*b* across the electronic substrate 30.

An advantage of the second embodiment is discussed below.

Assuming that the first contact electrode 32*a* and the second contact electrode 32*b* are aligned with each other in the insertion direction and that the first relay terminal 58*a* and the second relay terminal 58*b* are aligned with each other in the insertion direction, the second relay terminal 58*b* may be temporarily electrically connected to the first contact electrode 32*a* during insertion of the electronic substrate 30 into the substrate insertion hole 51. As a result, an electric current may flow accidentally.

As described above, according to the second embodiment, the first contact electrode 32*a* and the second contact electrode 32*b* are located in different positions in the lateral direction not to be aligned with each other in the insertion direction. Further, the first relay terminal 58*a* and the second relay terminal 58*b* are alternately arranged at predetermined intervals in the lateral direction in such a manner that the first relay terminal 58*a* and the second relay terminal 58*b* can come in contact with the first contact electrode 32*a* and the second contact electrode 32*b*, respectively. Therefore, it is less likely that the second relay terminal 58*b* will be temporarily electrically connected to the first contact electrode 32*a* during insertion of the electronic substrate 30 into the substrate insertion hole 51. Thus, accidental current flow can be prevented. Details are described below.

For example, assuming that the card edge connector 100 according to the second embodiment is used in a vehicle and that the casing 70 having the electronic substrate 30 is configured as an electronic control unit (ECU), the electronic substrate 30 is electrically connected through the harness 10 to other devices (e.g., battery and another ECU) mounted on the vehicle. In such a case, when the ECU is replaced with new one, a worker (e.g., repair man at a car dealer) may detach the electronic substrate 30 from the housing 50 under a condition that the harness 10 remains electrically connected to a battery of the vehicle. Further, an ECU used in a vehicle generally has a backup power source such as a capacitor. Therefore, the electronic substrate 30 may be detached from the housing 50 under a condition that power supply is continued by the battery or the backup power source. According to the second embodiment, he first contact electrode 32*a* and the second contact electrode 32*b* are located in different positions in the lateral direction not to be aligned with each other in the insertion direction. Therefore, even if the electronic substrate 30 is detached from the housing 50 under the condition that power supply is continued, accidental current flow can be prevented during insertion of the electronic substrate 30 into the substrate insertion hole 51.

Assuming that the first terminals 13*a* (or the second terminals 13*b*), which are located in the same position in the height direction and arranged in the lateral direction, the lengths of the housing 50 and the electronic substrate 30 in the lateral direction needs to be increased so that adjacent first terminals 13*a* (or adjacent second terminals 13*b*) can be spaced from each other in the lateral direction by enough distance to prevent adjacent first relay terminals 58*a* (or adjacent second relay terminals 58*b*) from coming in contact with each other and to prevent the first relay terminal 58*a* (or the second relay terminal 58*b*) from coming in contact with a non-corresponding first contact electrode 32*a* (or a non-corresponding second relay terminal 58*b*). In this case, the size of the housing 50 in the lateral direction needs to be increased in order to keep the number of necessary terminals 13.

According to the second embodiment, the first and second terminals 13*a*, 13*b* are located in different positions in the height direction and alternately arranged in the lateral direction in the housing 50. Therefore, the first and second relay terminals 58*a*, 58*b* are located in different positions in the height direction and alternately arranged in the lateral direction in the housing 50. In such an approach, even when the distance between adjacent first and second terminals 13*a*, 13*b* in the lateral direction is small, it is less likely that adjacent first and second relay terminals 58*a*, 58*b* will come in contact with each other and the relay terminal 58 will come in contact with a non-corresponding contact electrode 32. Thus, the number of necessary terminals 13 can be kept without increasing the size of the housing 50.

Figure 10:
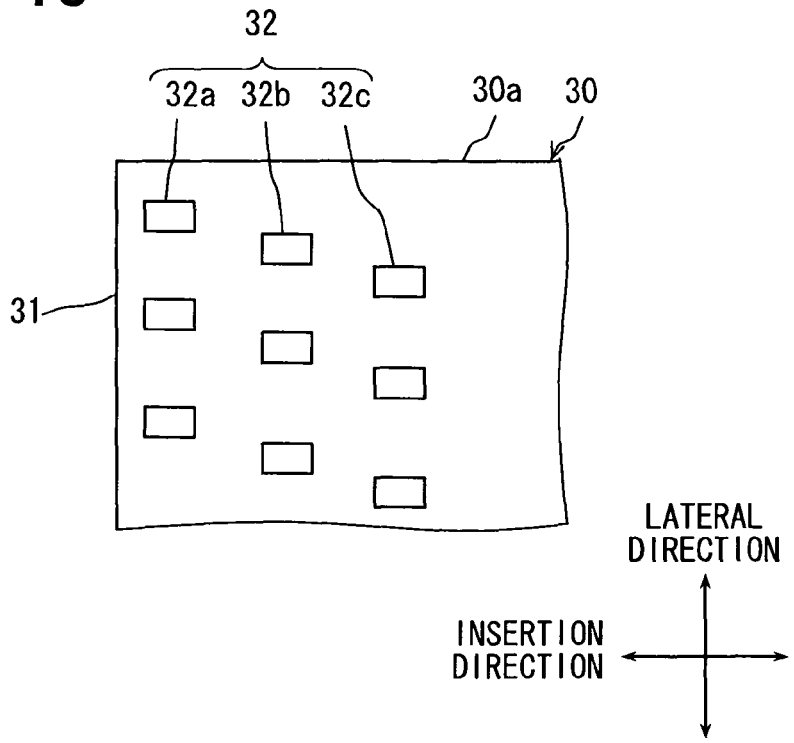
FIG. 10 is a diagram illustrating a plan view for explaining a layout of a contact electrode on an electronic substrate of a card edge connector according to a modification of the second embodiment.

According to the second embodiment, as shown in FIG. 9, the contact electrode 32 has the first contact electrode 32*a* and the second contact electrode 32*b*. Alternatively, as shown in FIG. 10, the contact electrode 32 can further have a third contact electrode 32*c* in addition to the first contact electrode 32*a* and the second contact electrode 32*b*. The third contact electrode 32*c* is located farther away from the tip of the end portion 31 of the electronic substrate 30 than the second contact electrode 32*b* in the insertion direction. In this case, the terminal 13 has a third terminal in addition to the first terminal 13*a* and the second terminal 13*b*, and the first, second, and third terminals are located in different positions in the height direction. FIG. 10 is a plan view for explaining a layout of the contact electrode 32 on the electronic substrate 30 according to a modification of the second embodiment.

In the modification shown in FIG. 10, two first contact electrodes 32*a*, which are located adjacent to each other in the lateral direction across one second contact electrode 32*b* and one third contact electrode 32*c*, are spaced from each other in the lateral direction by a predetermined distance that allows the electrode contact portions 61 of the relay terminals 58, corresponding to the second and third contact electrodes 32*b*, 32*c*, to come in contact with the second and third contact electrodes 32*b*, 32*c* without coming in contact with the first contact electrode 32*a* during insertion of the electronic substrate 30 into the substrate insertion hole 51. Further, the first contact electrode 32*a* and the second contact electrode 32*b*, which are located adjacent to each other in the lateral direction across on third contact electrode 32*c*, are spaced from each other in the lateral direction by a predetermined distance that allows the electrode contact portion 61 of the relay terminal 58, corresponding to the third contact electrode 32*c*, to come in contact with the third contact electrode 32*c* without coming in contact with the first and second contact electrodes 32*a*, 32*b* during insertion of the electronic substrate 30 into the substrate insertion hole 51.

As described above, according to the modification of the second embodiment, the contact electrode 32 further has the third contact electrode 32*c* in addition to the first contact electrode 32*a* and the second contact electrode 32*b*. In such an approach, the number of signal lines of the card edge connector 100 can be increased.

(Third Embodiment)

Figure 11:
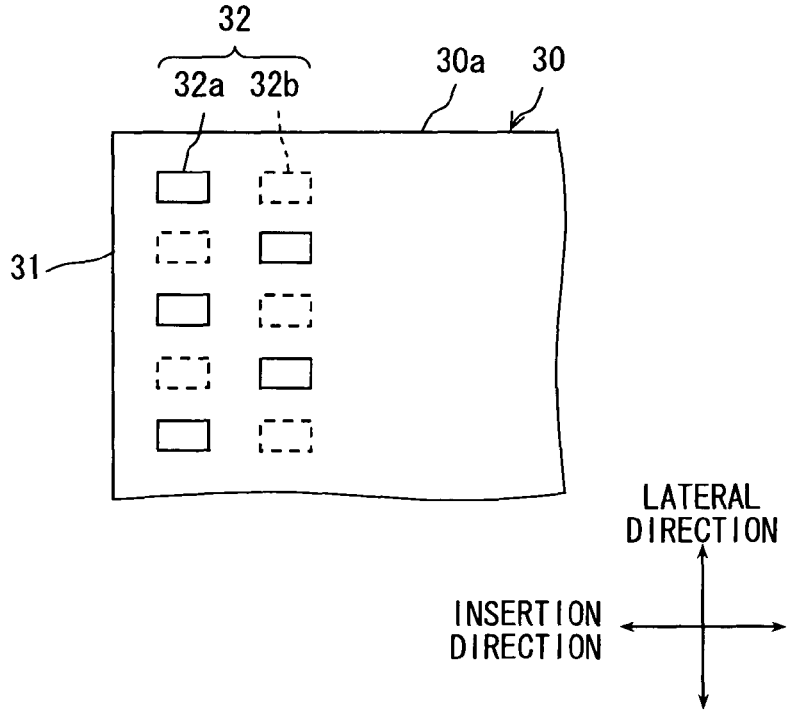
FIG. 11 is a diagram illustrating a cross-sectional view for explaining a layout of a contact electrode on an electronic substrate of a card edge connector according to a third embodiment of the present invention.
Figure 12:
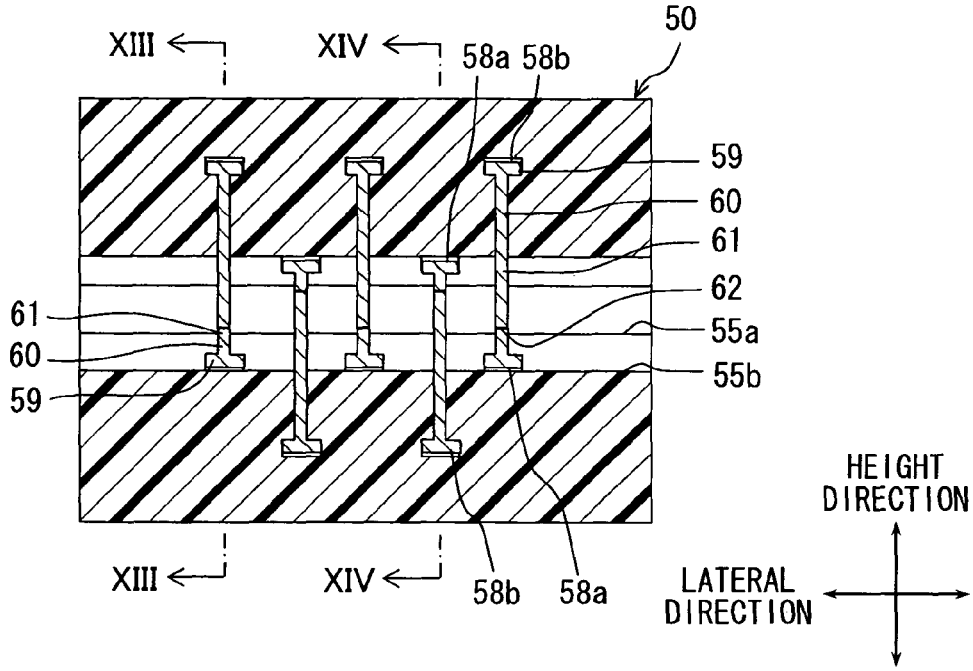
FIG. 12 is a diagram illustrating a cross-sectional view for explaining a layout of a relay terminal in a housing of the card edge connector according to the third embodiment.
Figure 13:
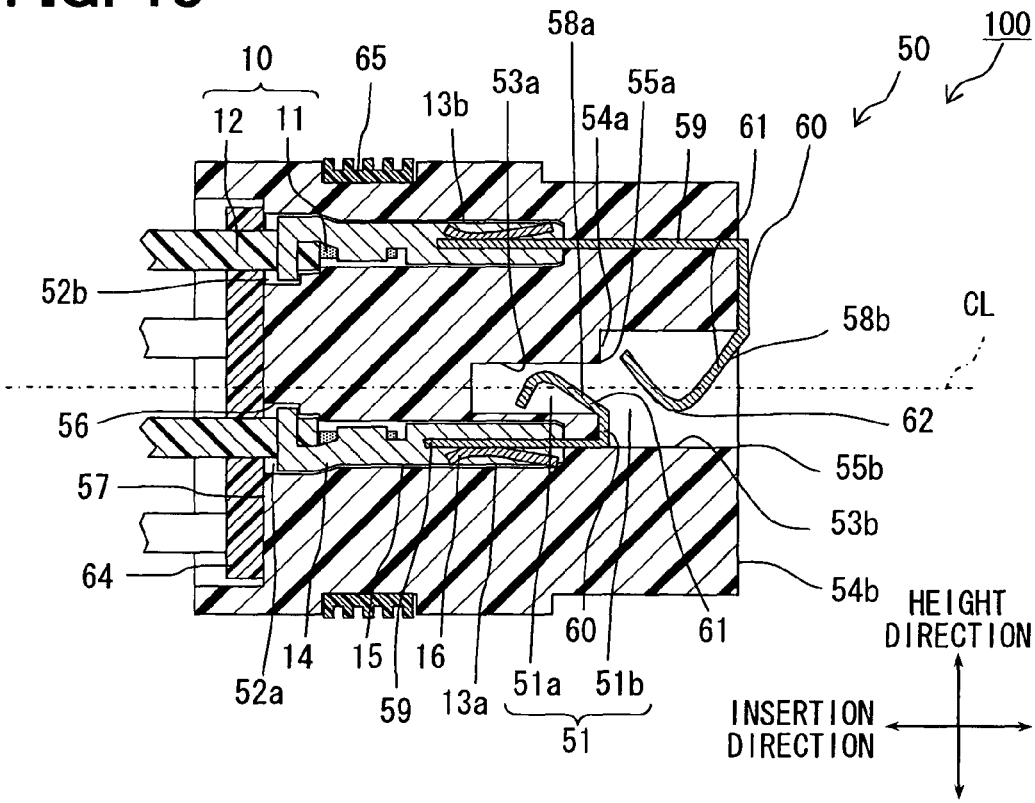
FIG. 13 is a diagram illustrating a cross-sectional view taken along the line XIII-XIII in FIG. 12.
Figure 14:
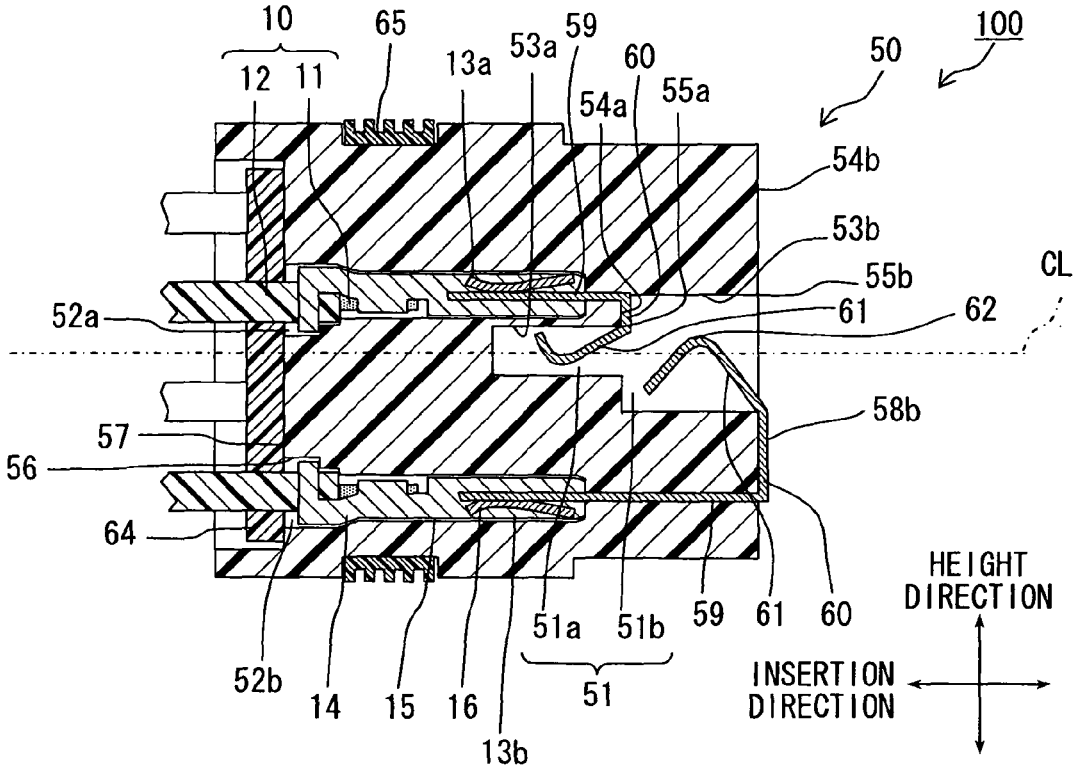
FIG. 14 is a diagram illustrating a cross-sectional view taken along the line XIV-XIV in FIG. 12.

A card edge connector 100 according to the third embodiment of the present invention is described below with reference to FIGS. 11-14. FIG. 11 is a cross-sectional view for explaining a layout of the contact electrode 32 on the electronic substrate 30. FIG. 12 is a cross-sectional view for explaining a layout of the relay terminal 58 in the housing 50. FIG. 13 is a cross-sectional view taken along the line XIII-XIII in FIG. 12. FIG. 14 is a cross-sectional view taken along the line XIV-XIV in FIG. 12. For FIG. 9 is a plan view for explaining a layout of the contact electrode 32 on the electronic substrate 30. For the sake of simplicity, the contact electrode 32 on the back surface 30*b* of the electronic substrate 30 is indicated by a broken line in FIG. 11.

A difference of the third embodiment from the preceding embodiments is as follows.

In the first embodiment, the first contact electrode 32*a* on the front surface 30*a* is located directly opposite the first contact electrode 32*a* on the back surface 30*b* across the electrode substrate 30, and the second contact electrode 32*b* on the front surface 30*a* is located directly opposite the second contact electrode 32*b* on the back surface 30*b* across the electronic substrate 30.

In contrast, in the third embodiment, as shown in FIG. 11, the first contact electrode 32*a* and the second contact electrode 32*b* are alternately arranged in the lateral direction to form a first zigzag pattern on the front surface 30*a* of the electronic substrate 30 and to form a second zigzag pattern on the back surface 30*b* of the electronic substrate 30. The first zigzag pattern on the front surface 30*a* and the second zigzag pattern on the back surface 30*b* are symmetric with respect to a line. In other words, the first contact electrode 32*a* on the front surface 30*a* and the second contact electrode 32*b* on the back surface 30*b* are aligned in the insertion direction, and the second contact electrode 32*b* on the front surface 30*a* and the first contact electrode 32*a* on the back surface 30*b* are aligned in the insertion direction.

Further, as shown in FIG. 12, one first relay terminal 58*a* and one second relay terminal 58*b* are paired to form one relay terminal pair and aligned in the height direction. The relay terminal pairs are arranged at predetermined intervals in the lateral direction. Specifically, as shown in FIG. 13, the first relay terminal 58*a* to be connected to the first contact electrode 32*a* on the front surface 30*a* and the second relay terminal 58*b* to be connected to the second contact electrode 32*b* on the back surface 30*b* are paired to form a first relay terminal pair and aligned in the height direction. Then, as shown in FIG. 14, the second relay terminal 58*b* to be connected to the second contact electrode 32*b* on the front surface 30*a* and the first relay terminal 58*a* to be connected to the first contact electrode 32*a* on the back surface 30*b* are paired to form a second relay terminal pair and aligned in the height direction.

The electrode contact portion 61 of the first relay terminal 58*a* to be connected to the first contact electrode 32*a* on the front surface 30*a* and the electrode contact portion 61 of the second relay terminal 58*b* to be connected to the second contact electrode 32*b* on the back surface 30*b* extend over the center line CL from the front surface 30*a* side to the back surface 30*b* side so that the vertex 62 of the electrode contact portions 61 can be located below the center Line CL in the height direction. Likewise, the electrode contact portion 61 of the second relay terminal 58*b* to be connected to the second contact electrode 32*b* on the front surface 30*a* and the electrode contact portion 61 of the first relay terminal 58*a* to be connected to the first contact electrode 32*a* on the back surface 30*b* extend over the center line CL from the back surface 30*b* side to the front surface 30*a* side so that the vertex 62 of the electrode contact portions 61 can be located above the center Line CL in the height direction.

An advantage of the third embodiment with respect to the preceding embodiments is discussed below.

In the structure shown in FIGS. 7 and 8, the vertex 62 of two first relay terminals 58*a* are located opposite each other with a predetermined distance that not only prevents the vertex 62 of the first relay terminals 58*a* from coming in contact with each other before insertion of the electronic substrate 30 into the substrate insertion hole 51 but also allows the electrode contact portions 61 of the first relay terminals 58*a* to be elastically deformed after insertion of the electronic substrate 30 into the substrate insertion hole 51 so that the electrode contact portions 61 of the first relay terminals 58*a* can remain in contact with the first contact electrodes 32*a* at the predetermined contact pressure. Likewise, the vertex 62 of two second relay terminals 58*b* are located opposite each other with a predetermined distance that not only prevents the vertex 62 of the second relay terminals 58*b* from coming in contact with each other before insertion of the electronic substrate 30 into the substrate insertion hole 51 but also allows the electrode contact portions 61 of the second relay terminals 58*b* to be elastically deformed so that the electrode contact portions 61 of the second relay terminals 58*b* can remain in contact with the second contact electrodes 32*b* at the predetermined contact pressure after insertion of the electronic substrate 30 into the substrate insertion hole 51. That is, the vertex 62 of the relay terminal 58 to be connected to the contact electrode 32 on the front surface 30*a* needs to be located between the front surface 30*a* and the center line CL in the height direction, and the vertex 62 of the relay terminal 58 to be connected to the contact electrode 32 on the back surface 30*b* needs to be located between the back surface 30*b* and the center line CL in the height direction. Therefore, robustness, i.e., a manufacturing tolerance of the relay terminal 58 may be low. In other words, the relay terminal 58 needs to be accurately placed in the housing 50.

Further, in the structure shown in FIGS. 7 and 8, a distance (i.e., stroke) for allowing the electrode contact portion 61 to be elastically deformed is at most half of the thickness of the electronic substrate 30. Therefore, the contact pressure for allowing the electrode contact portion 61 to be in contact with the contact electrode 32 may be insufficient.

In contrast, according to the third embodiment, as shown in FIG. 11, the first contact electrode 32*a* on the front surface 30*a* and the second contact electrode 32*b* on the back surface 30*b* are aligned in the insertion direction, and the second contact electrode 32*b* on the front surface 30*a* and the first contact electrode 32*a* on the back surface 30*b* are aligned in the insertion direction. The first relay terminal 58*a* to be connected to the first contact electrode 32*a* on the front surface 30*a* and the second relay terminal 58*b* to be connected to the second contact electrode 32*b* on the back surface 30*b* are paired and aligned in the height direction, and the second relay terminal 58*b* to be connected to the second contact, electrode 32*b* on the front surface 30*a* and the first relay terminal 58*a* to be connected to the first contact electrode 32*a* on the back surface 30*b* are paired and aligned in the height direction. In such an approach, the vertex 62 of the relay terminals 58 that are alighted in the height direction are located in different positions in the insertion direction and not located opposite each other in the height direction. Therefore, even if a manufacturing error occurs in positions of the vertex 62, it is less likely that the vertex 62 will come in contact with each other.

Further, according to the third embodiment, the electrode contact portion 61 of the first relay terminal 58*a* to be connected to the first contact electrode 32*a* on the front surface 30*a* and the electrode contact portion 61 of the second relay terminal 58*b* to be connected to the second contact electrode 32*b* on the back surface 30*b* extend over the center line CL from the front surface 30*a* side to the back surface 30*b* side so that the vertex 62 of the electrode contact portions 61 can be located below the center Line CL in the height direction. Likewise, the electrode contact portion 61 of the second relay terminal 58*b* to be connected to the second contact electrode 32*b* on the front surface 30*a* and the electrode contact portion 61 of the first relay terminal 58*a* to be connected to the first contact electrode 32*a* on the back surface 30*b* extends over the center line CL from the back surface 30*b* side to the front surface 30*a* side so that the vertex 62 of the electrode contact portions 61 can be located above the center Line CL in the height direction. In such an approach, since the distance for allowing the electrode contact portion 61 to be elastically deformed can be greater than half of the thickness of the electronic substrate 30, it is ensured that the electrode contact portion 61 remains in contact with the corresponding contact electrode 32 at a sufficient contact pressure.

For foregoing reasons, according to the third embodiment, a reliable electrical connection between the electrode contact portion 61 and the contact electrode 32 can be ensured.

It is noted that when the electronic substrate 30 is inserted into the substrate insertion hole 51, the electrode contact portion 61 of the second relay terminal 58*b* is displaced in the insertion direction. Therefore, for example, as shown in FIG. 1, if the first relay terminal 58*a* is located in a direction in which the second relay terminal 58*b* is displaced, the second relay terminal 58*b* may come in contact with the first relay terminal 58*a* due to the displacement of the second relay terminal 58*b*. As a result, a shot-circuit may occur.

In contrast, according to the third embodiment, as shown in FIGS. 13 and 14, the electrode contact portion 61 of the first relay terminal 58*a* is not located in a direction in which the electrode contact portion 61 of the second relay terminal 58*b* is displaced during insertion of the electronic substrate 30 into the substrate insertion hole 51. Therefore, it is less likely that the second relay terminal 58*b* will come in contact with the first relay terminal 58*a*. Further, the displacement of the electrode contact portion 61 of the second relay terminal 58*b* is limited by the first housing surface 54*a*. Therefore, by locating the electrode contact portion 61 of the first relay terminal 58*a* in front of the first housing surface 54*a* in the insertion direction, the second relay terminal 58*b* does not come in contact with the first relay terminal 58*a* during insertion of the electronic substrate 30 into the substrate insertion hole 51.

Figure 15:
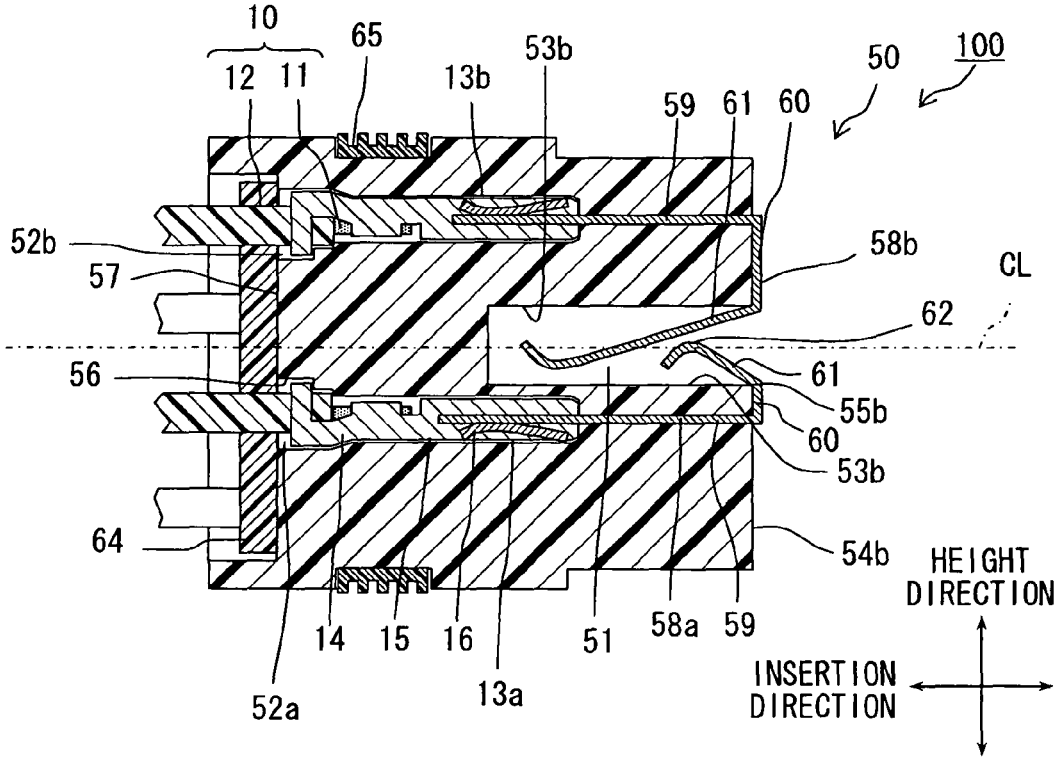
FIG. 15 is diagram illustrating a cross-sectional view of a card edge connector according to a modification of the third embodiment and corresponding to FIG. 13.
Figure 16:
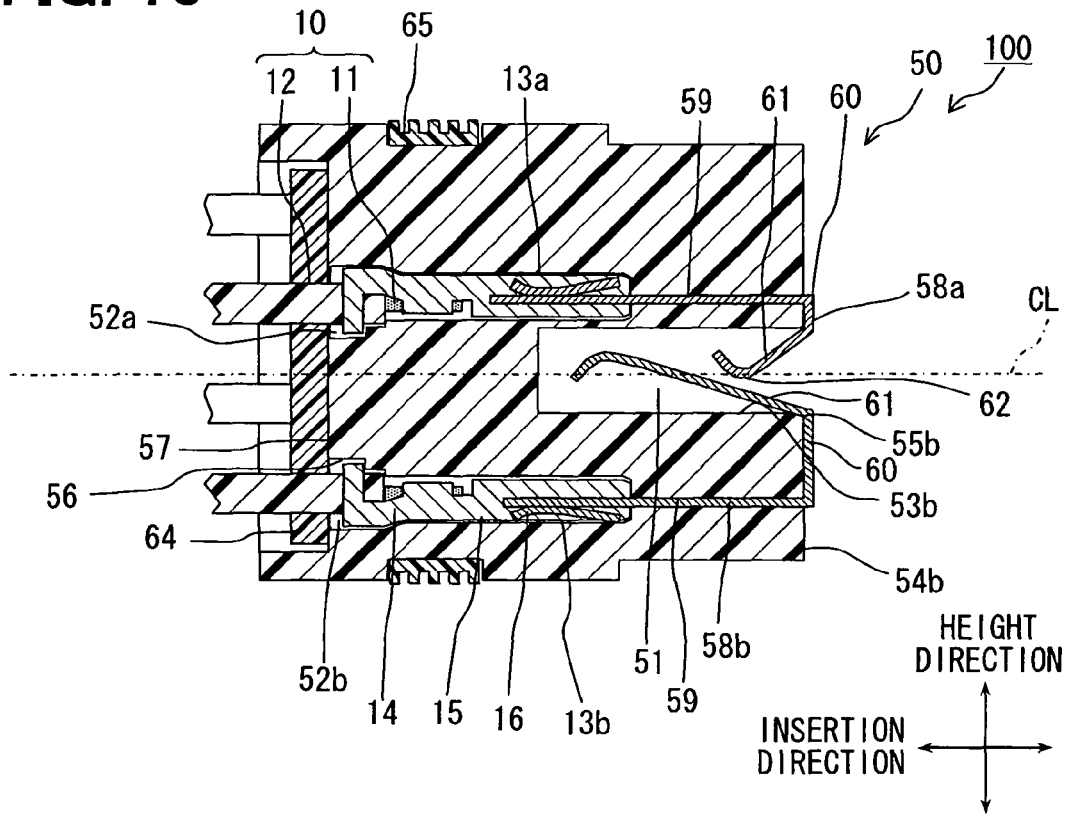
FIG. 16 is diagram illustrating a cross-sectional view of the card edge connector according to the modification of the third embodiment and corresponding to FIG. 14.

The third embodiment described above can be modified, for example, as follows. In the third embodiment, the relay terminal 58 has the first relay terminal 58*a* for electrically connecting the first terminal 13*a* to the first contact electrode 32*a* on each of the front surface 30*a* and the back surface 30*b* and the second relay terminal 58*b* for electrically connecting the second terminal 13*b* to the second contact electrode 32*b* on each of the front surface 30*a* and the back surface 30*b*. Alternatively, for example, as shown in FIGS. 15 and 16, the first relay terminal 58*a* can electrically connect the first terminal 13*a* to the second contact electrode 32*b* on each of the front surface 30*a* and the back surface 30*b*, and the second relay terminal 58*b* can electrically connect the second terminal 13*b* to the first contact electrode 32*a* on each of the front surface 30*a* and the back surface 30*b*. FIG. 15 is a cross-sectional view of a card edge connector 100 according to a modification of the third embodiment and corresponds to FIG. 13. FIG. 16 is a cross-sectional view of the card edge connector 100 according to the modification of the third embodiment and corresponds to FIG. 14.

According to the modification shown in FIGS. 15 and 16, the electrode contact portion 61 of the second relay terminal 58*b* to be connected to the first contact electrode 32*a* on the front surface 30*a* overlaps the electrode contact portion 61 of the first relay terminal 58*a* to be connected to the second contact electrode 32*b* on the front surface 30*a* in the insertion direction. Likewise, the electrode contact portion 61 of the second relay terminal 58*b* to be connected to the first contact electrode 32*a* on the back surface 30*b* overlaps the electrode contact portion 61 of the first relay terminal 58*a* to be connected to the second contact electrode 32*b* on the back surface 30*b* in the insertion direction. Thus, the length of the substrate insertion hole 51 in the insertion direction is reduced so that the length of the electronic substrate 30 in the insertion direction can be reduced. Accordingly, the size of the card edge connector 100 as a whole is reduced.

Figure 17:
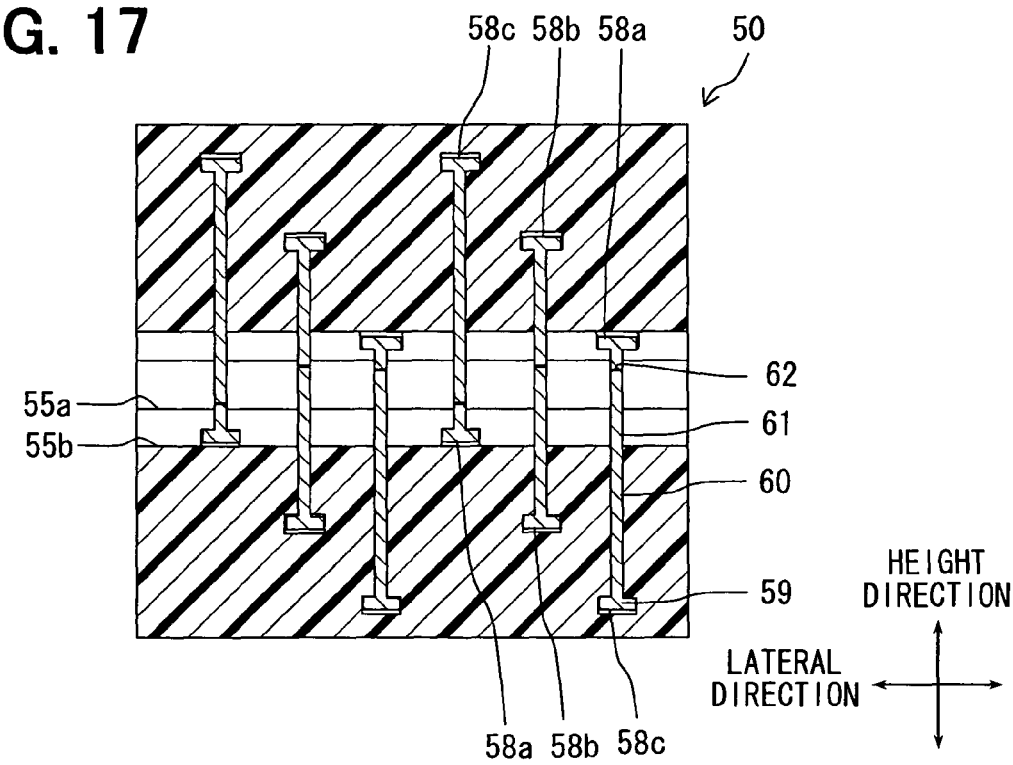
FIG. 17 is a diagram illustrating a cross-sectional view of a card edge connector according to another modification of the third embodiment and corresponding to FIG. 12.

Alternatively, as shown in FIG. 17, the relay terminal 58 can further have a third relay terminal 58*c* in addition to the first relay terminal 58*a* and the second relay terminal 58*b*. The third relay terminal 58*c* is located farther away from the front surface 30*a* or the back surface 30*b* of the electronic substrate 30 than the second terminal 13*b* in the height direction. In such an approach, the number of signal lines of the card edge connector 100 can be increased. In this case, the contact electrode 32 has a third contact electrode in addition to the first contact electrode 32*a* and the second contact electrode 32*b*, and the first, second, and third contact electrodes are located in different positions on the electrode substrate 30. FIG. 17 is a cross-sectional view of a card edge connector 100 according to another modification of the third embodiment and corresponds to FIG. 12.

Further, according to the modification shown in FIGS. 15 and 16, the narrow holes 66 for receiving the first relay terminal 58*a* and the second relay terminal 58*b* are both formed on the second housing surface 54*b*. Therefore, the press-fitting process is easy compared to when the narrow hole 66 for receiving the first relay terminal 58*a* is formed on the first housing surface 54*a*.

(Fourth Embodiment)

Figure 18:
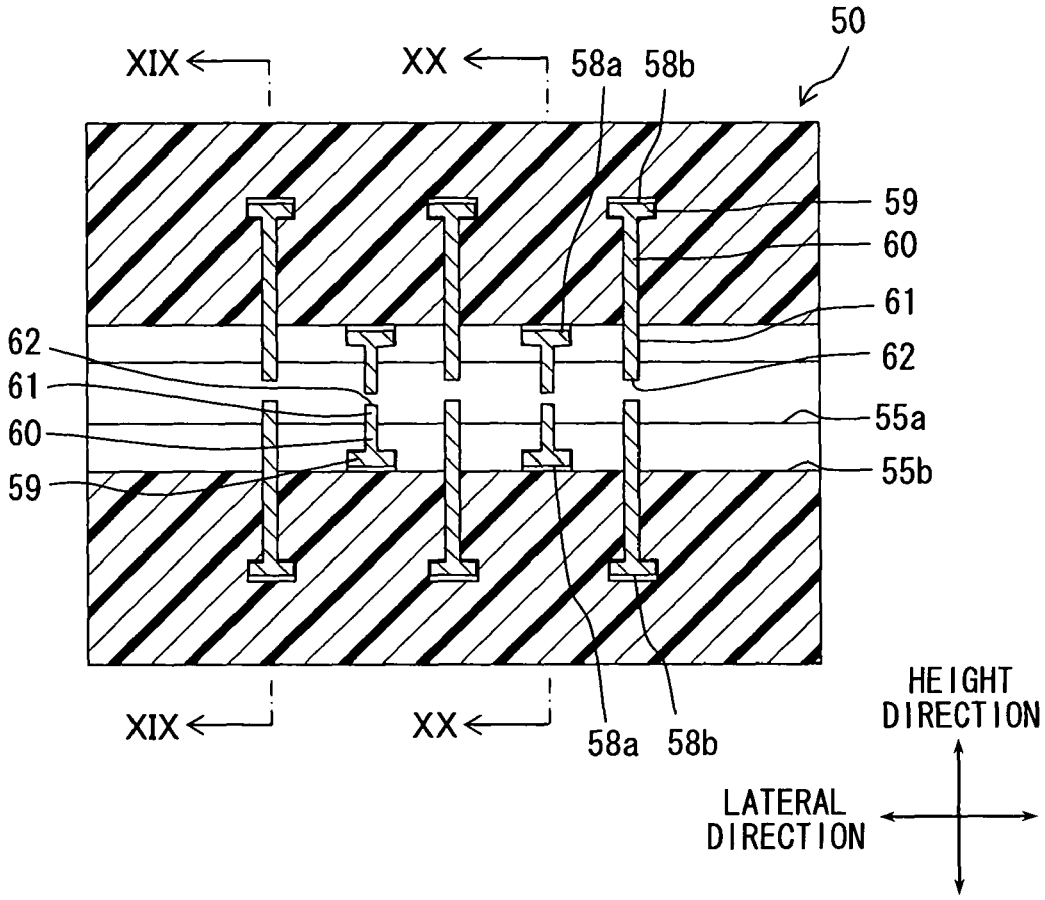
FIG. 18 is a diagram illustrating a cross-sectional view for explaining a layout of a relay terminal in a housing of a card edge connector according to a fourth embodiment of the present invention.
Figure 19:
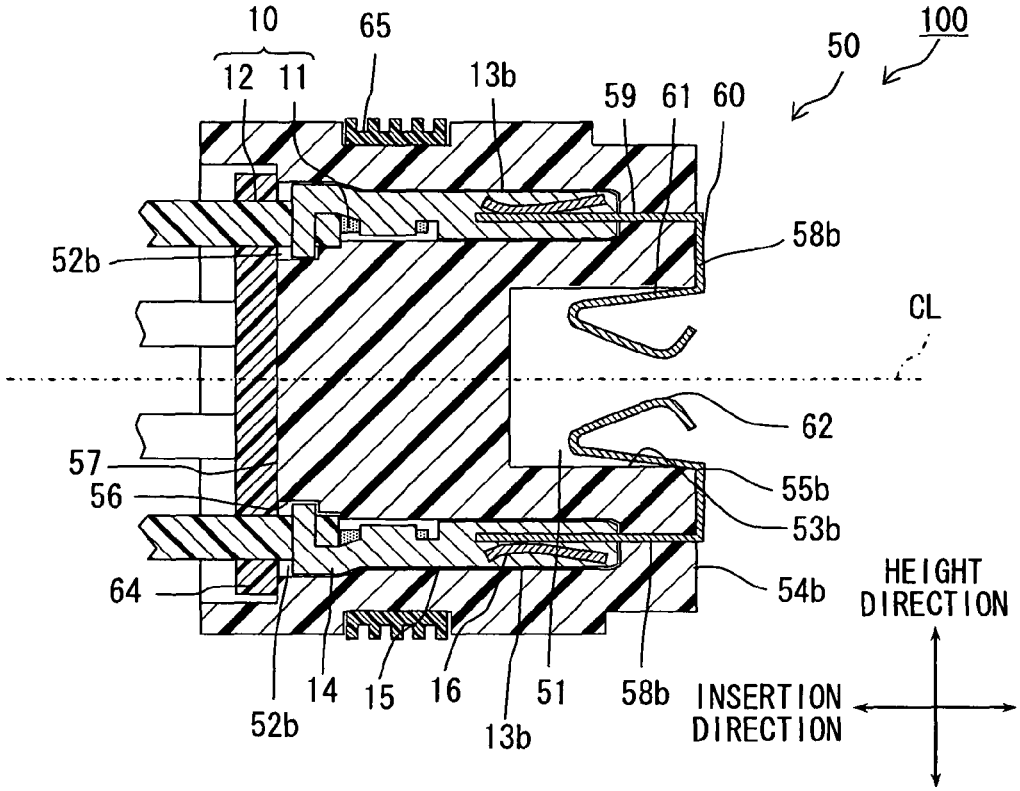
FIG. 19 is a diagram illustrating a cross-sectional view taken along the line XIX-XIX in FIG. 18.
Figure 20:
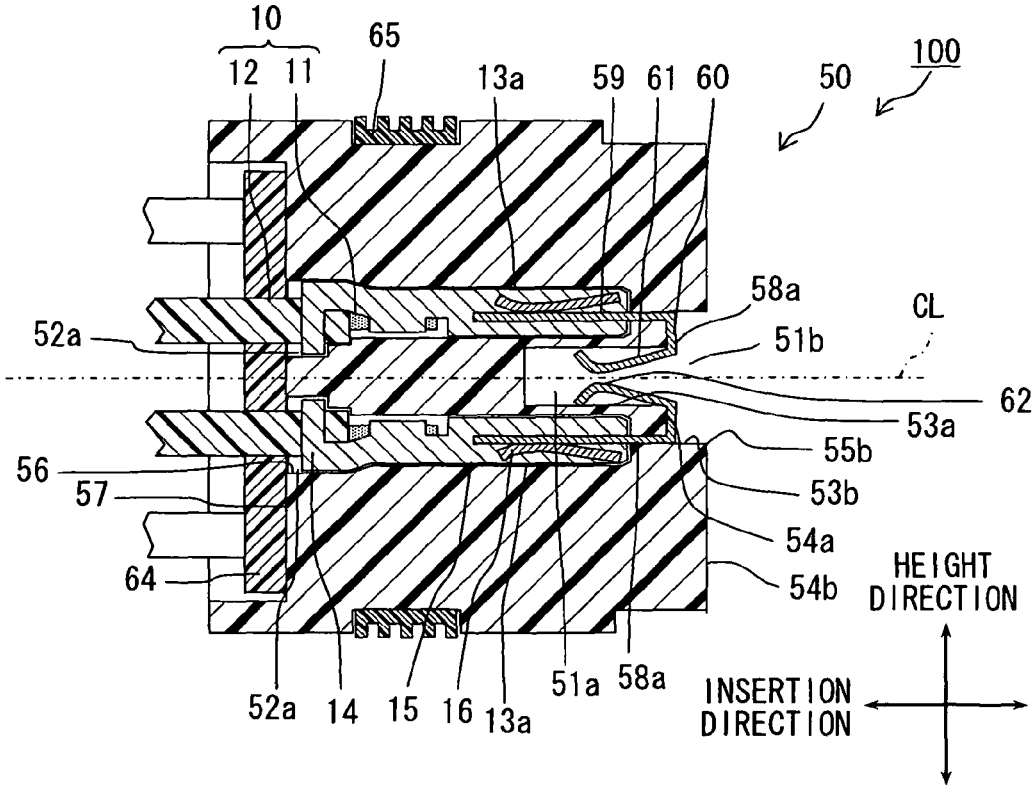
FIG. 20 is a diagram illustrating a cross-sectional view taken along the line XX-XX in FIG. 18.

A card edge connector 100 according to the fourth embodiment of the present invention is described below with reference to FIGS. 18-20. FIG. 18 is a cross-sectional view for explaining a layout of the relay terminal 58 in the housing 50. FIG. 19 is a cross-sectional view taken along the line XIX-XIX in FIG. 18. FIG. 20 is a cross-sectional view taken along the line XX-XX in FIG. 18.

A difference of the fourth embodiment from the preceding embodiments is as follows.

According to the fourth embodiment, the electrode contact portion 61 of the second relay terminal 58*b* is bent at a first position in a first direction along the insertion direction so that the electrode contact portion 61 can extend toward the inside of the substrate insertion hole 51 and then bent at a second position in a second direction opposite to the first direction along the insertion direction so that the electrode contact portion 61 can extend toward the outside of the substrate insertion hole 51. As shown in FIG. 19, the first position corresponds to the junction between the connecting portion 60 and the electrode contact portion 61.

The following discussion relates to the contact pressure at which the electrode contact portion 61 of the relay terminal 58 remains in contact with the contact electrode 32 after insertion of the electronic substrate 30 into the housing 50. The contact pressure is in proportion to a length of an elastically-deformed part of the electrode contact portion 61 and is in inverse proportion to a stroke of the elastically-deformed part. Therefore, when the length of the elastically-deformed part of the electrode contact portion 61 is short, a change in the contact pressure with the stroke is large. In contrast, when the length of the elastically-deformed part of the electrode contact portion 61 is long, the change in the contact pressure with the stroke is small. The contact pressure needs to be kept within a predetermined range that ensures reliability of electrical connection between the contact electrode 32 and the electrode contact portion 61. Increasing the length of the elastically-deformed part of the electrode contact portion 61 may keep the contact pressure within the predetermined range while absorbing manufacturing tolerances in the electronic substrate 30, the housing 50, and the contact electrode 32. It is noted that the length of the elastically-deformed part of the electrode contact portion 61 depends on a length of the end portion 31 that is inserted in the substrate insertion hole 51. For this reason, an increase in the length of the elastically-deformed part of the electrode contact portion 61 results in increases in the length of the substrate insertion hole 51 of the housing 50 and the length of the end portion 31 of the electronic substrate 30. Therefore, at least the housing 50 is increased in size. Further, due to a small clearance between the end portion 31 and the substrate insertion hole 51 after insertion of the end portion 31 into the substrate insertion hole 51, it is difficult to mount electronic devices on the end portion 31. Therefore, in order to maintain the number of electronic devices mounted on the electronic substrate 30, the size of the electronic substrate 30 is increased by the increase in the length of the end portion 31. In summary, the increase in the length of the elastically-deformed part of the electrode contact portion 61 results in not only the increase in the size of the housing 50 but also the increase in the size of the electronic substrate 30.

Regarding the issue of the contact pressure, according to the fourth embodiment, the electrode contact portion 61 of the second relay terminal 58*b* is bent in the first direction along the insertion direction toward the inside of the substrate insertion hole 51 and then bent in the second direction along the insertion direction toward the outside of the substrate insertion hole 51. That is, the electrode contact portion 61 is bent twice in opposite directions along the insertion direction. In such an approach, the contact pressure can be kept within the predetermined range without increasing the length of the electrode contact portion 61. That is, the contact pressure can be kept within the predetermined range without increasing the size of the housing 50 and the electronic substrate 30.

Further, according to the fourth embodiment, as shown in FIGS. 18-20, the first relay terminal 58*a* and the second relay terminal 58*b* are alternately arranged at predetermined intervals in the lateral direction, and the electrode contact portion 61 of the first relay terminal 58*a* overlap the electrode contact portion 61 of the second relay terminal 58*b* in the insertion direction. Thus, the length of the substrate insertion hole 51 in the insertion direction is reduced so that the length of the electronic substrate 30 in the insertion direction can be reduced. Accordingly, the size of the card edge connector 100 as a whole is reduced.

Figure 21:
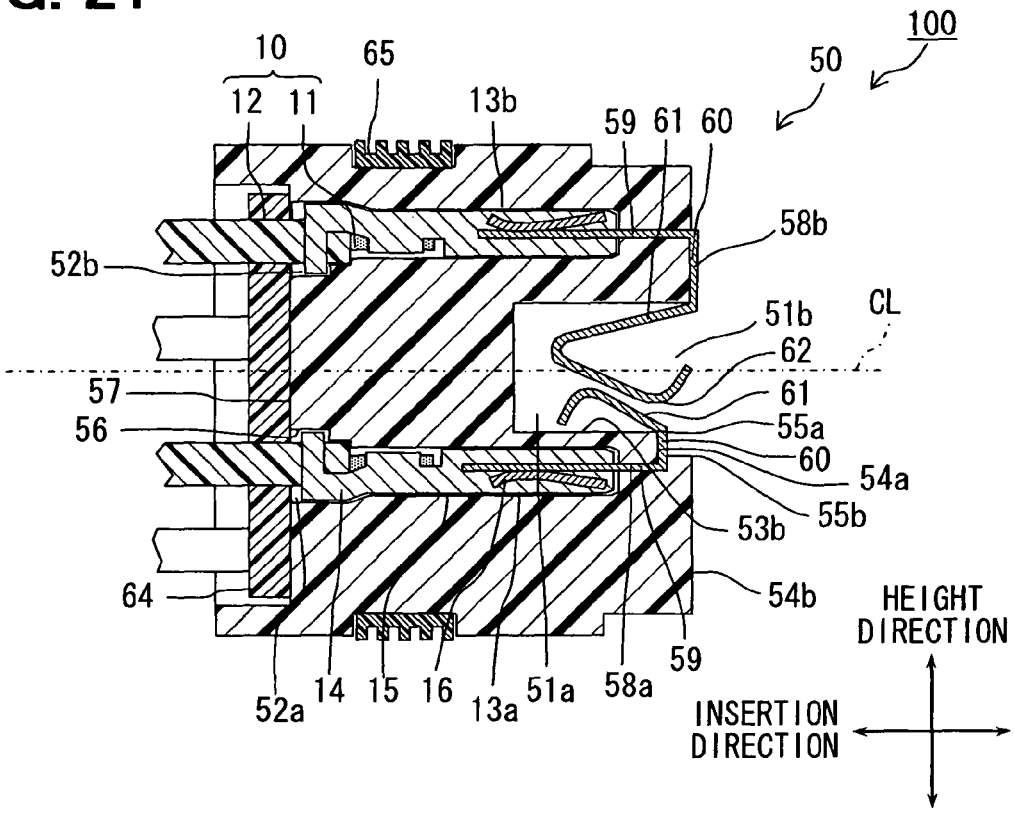
FIG. 21 is a diagram illustrating a cross-sectional view of a card edge connector according to a modification of the fourth embodiment and corresponding to FIG. 19.
Figure 22:
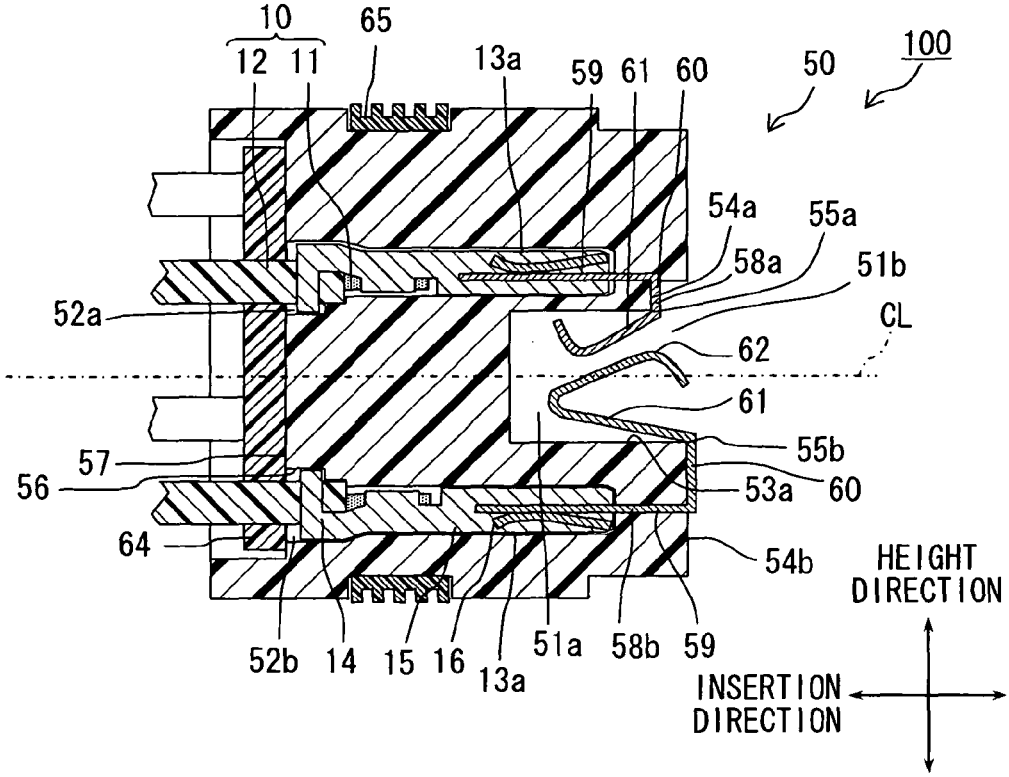
FIG. 22 is a diagram illustrating a cross-sectional view of the card edge connector according to the modification of the fourth embodiment and corresponding to FIG. 20.
Figure 23:
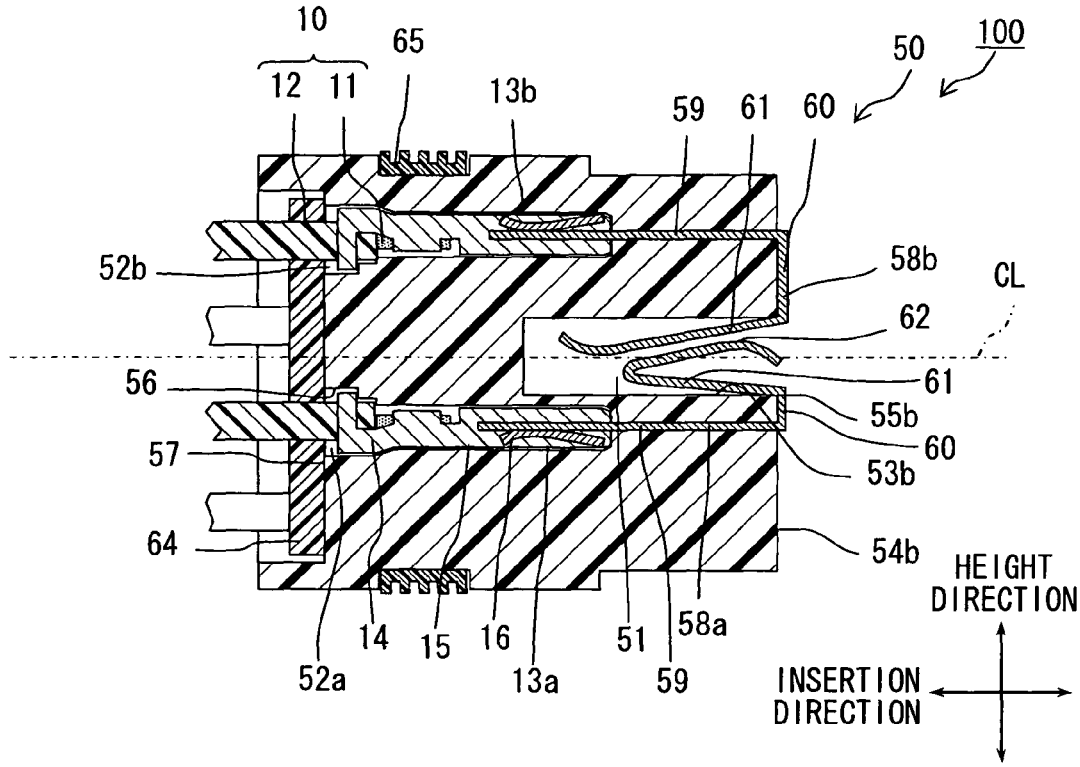
FIG. 23 is a diagram illustrating a cross-sectional view of a card edge connector according to another modification of the fourth embodiment and corresponding to FIG. 19.
Figure 24:
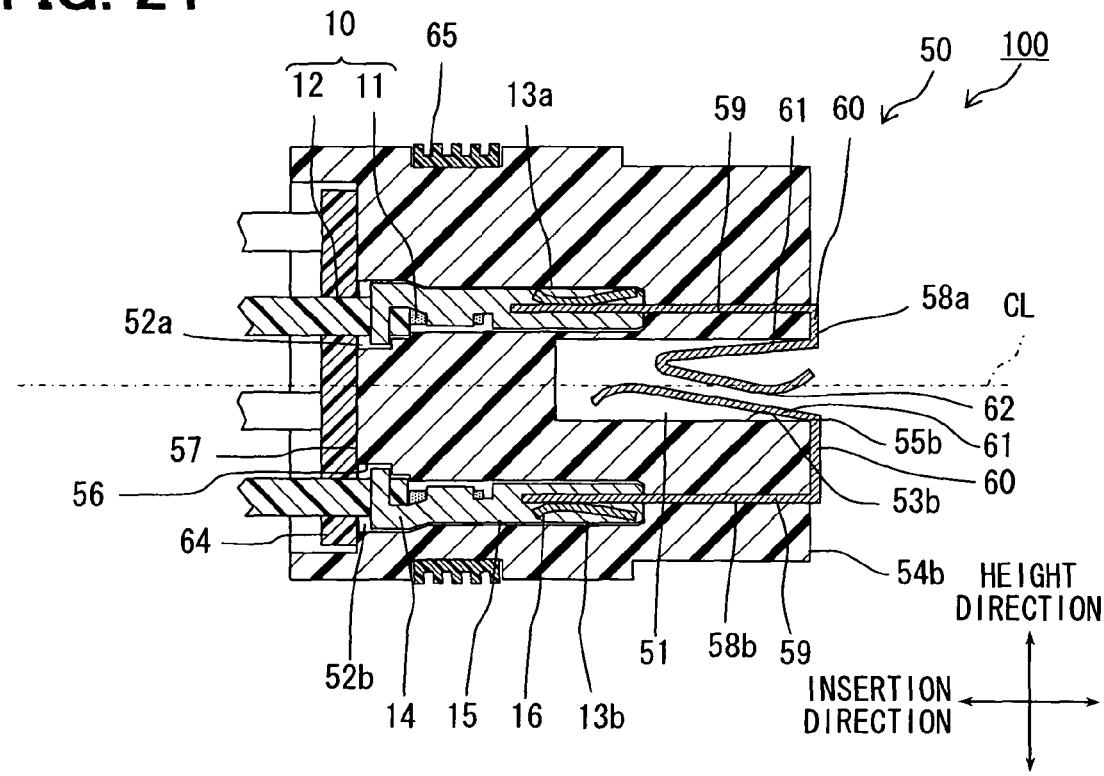
FIG. 24 is a diagram illustrating a cross-sectional view of the card edge connector according to the other modification of the fourth embodiment and corresponding to FIG. 20.

The fourth embodiment described above can be modified, for example, as follows. In the fourth embodiment, the vertex 62 of two first relay terminals 58*a* are located opposite each other in the height direction, and the vertex 62 of two second relay terminals 58*b* are located opposite each other in the height direction. Alternatively, as shown in FIGS. 21-24, the vertex 62 of the first relay terminal 58*a* and the second relay terminal 58*b* that are paired and aligned in the height direction can be located in different positions in the insertion direction so that the vertex 62 cannot be located opposite each other in the height direction. FIG. 21 is a cross-sectional view of a card edge connector 100 according to a modification of the fourth embodiment and corresponds to FIG. 19. FIG. 22 is a cross-sectional view of the card edge connector 100 according to the modification of the fourth embodiment and corresponds to FIG. 20. FIG. 23 is a cross-sectional view of a card edge connector 100 according to another modification of the fourth embodiment and corresponds to FIG. 19. FIG. 24 is a cross-sectional view of the card edge connector 100 according to the other modification of the fourth embodiment and corresponds to FIG. 20.

In the card edge connector 100 shown in FIGS. 21 and 22, the electrode contact portion 61 of the second relay terminal 58*b* is bent twice in opposite directions along the insertion direction. Specifically, before insertion of the electronic substrate 30 into the substrate insertion hole 51, a straight part between the second bent position and the vertex 62 of the electrode contact portion 61 of the second relay terminal 58*b* is parallel to a straight part between the junction between the connecting portion 60 and the electrode contact portion 61 and the vertex 62 of the electrode contact portion 61 of the first relay terminal 58*a*. In such an approach, the electrode contact portions 61 of the first and second relay terminals 58*a*, 58*b* can be located close to each other so that the size of the substrate insertion hole 51 in the height direction can be reduced.

In the card edge connector 100 shown in FIGS. 23 and 24, the electrode contact portion 61 of the first relay terminal 58*a* is bent twice in opposite directions along the insertion direction. Specifically, before insertion of the electronic substrate 30 into the substrate insertion hole 51, a straight part between the second bent position and the vertex 62 of the electrode contact portion 61 of the first relay terminal 58*a* is parallel to a straight part between the junction between the connecting portion 60 and the electrode contact portion 61 and the vertex 62 of the electrode contact portion 61 of the second relay terminal 58*b*. In such an approach, the electrode contact portions 61 of the first and second relay terminals 58*a*, 58*b* can be located close to each other so that the size of the substrate insertion hole 51 in the height direction can be reduced.

In FIGS. 19, 21, and 22, a tip of the second relay terminal 58*b* is located closer to the opening of the substrate insertion hole 51 than the vertex 62 of the second relay terminal 58*b*. In this case, if the vertex 62 of the second relay terminal 58*b* is located on opposite side of the connecting portion 60 of the second relay terminal 58*b* across the center line CL, it is preferable that the tip of the second relay terminal 58*b* should be located on opposite side of the vertex 62 of the second relay terminal 58*b* across the center line CL. In such an approach, when the electronic substrate 30 is inserted in the substrate insertion hole 51 along the center line CL, a part between the tip and the vertex 62 of the second relay terminal 58*b* is pressed by the electronic substrate 30 so that the electronic substrate 30 can be surely, properly inserted in the substrate insertion hole 51.

For the same reason as described above, in FIGS. 23, 24, if the vertex 62 of the first relay terminal 58*a* is located on opposite side of the connecting portion 60 of the first relay terminal 58*a* across the center line 30. CL, it is preferable that the tip of the first relay terminal 58*a* should be located on opposite side of the vertex 62 of the first relay terminal 58*a* across the center line CL.

The embodiments described above can be modified in various ways. For example, the electrode contact portion 61 can be bent more than twice.

Such changes and modifications are to be understood as being within the scope of the present invention as defined by the appended claims.

What is claimed is:

1. A card edge connector adapted to receive an electronic substrate, the electronic substrate including a plurality of contact electrodes on a surface of an end portion of the electronic substrate, the plurality of contact electrodes including a first contact electrode and a second contact electrode, the first contact electrode located in front of the second contact electrode in an insertion direction in which the end portion of the electronic substrate is adapted to be inserted into the card edge connector, the card edge connector comprising:

a housing defining an substrate insertion hole for receiving the end portion of the electronic substrate;

a plurality of harness terminals located in the housing and including a first harness terminal located in a first distance from the surface of the end portion of the electronic substrate in a height direction perpendicular to the surface after insertion of the end portion into the substrate insertion hole, the plurality of harness terminals further including a second harness terminal located in a second distance from the surface of the end portion in the height direction after insertion of the end portion into the substrate insertion hole, the second distance greater than the first distance;

a plurality of relay terminals located in the housing, each of the plurality of relay terminals having a first end in contact with a corresponding harness terminal, and a second end in contact with a corresponding contact electrode, to thereby establish the entire electrical connection between the corresponding harness terminal and the corresponding contact electrode when the end portion is inserted into the substrate insertion hole, the plurality of relay terminals including a first relay terminal configured to electrically connect the first harness terminal to one of the first contact electrode and the second contact electrode when the end portion is inserted into the substrate insertion hole, the plurality of relay terminals further including a second relay terminal configured to electrically connect the second harness terminal to the other of the first contact electrode and the second contact electrode when the end portion is inserted into the substrate insertion hole; and a plurality of harnesses, each harness having a third end connected to a corresponding harness terminal and a fourth end exposed outside the housing, the plurality of harnesses including a first harness connected to the first harness terminal and a second harness connected to the second harness terminal.

2. The card edge connector according to claim 1, wherein each of the first harness terminal and the second harness terminal includes a tubular body and a contact located in the tubular body, and the contact is elastically deformed to be in contact with a corresponding relay terminal at a predetermined contact pressure.

3. The card edge connector according to claim 1, further comprising:

a sealing member including a plurality of sealing portions that are joined together, wherein the housing further defines a plurality of harness holes through which the plurality of harnesses is exposed outside the housing, and each sealing portion is located around an opening of a corresponding harness hole to seal a clearance between the housing and a corresponding harness.

4. The card edge connector according to claim 1, wherein the first contact electrode comprises a plurality of first contact electrodes that are aligned with each other on the surface of the end portion in a lateral direction perpendicular to each of the insertion direction and the height direction, the second contact electrode comprises a plurality of second contact electrodes that are aligned with each other on the surface of the end portion in the lateral direction, and the plurality of first contact electrodes is not aligned with the plurality of second contact electrodes in the insertion direction.

5. The card edge connector according to claim 4, wherein the first relay terminal includes a first electrode contact portion located in the substrate insertion hole and extending in the insertion direction, the first electrode contact portion elastically deformed to be in contact with the one of the first contact electrode and the second contact electrode after insertion of the end portion into the substrate insertion hole, the second relay terminal includes a second electrode contact portion located in the substrate insertion hole and extending in the insertion direction, the second electrode contact portion elastically deformed to be in contact with the other of the first contact electrode and the second contact electrode after insertion of the end portion into the substrate insertion hole, and the first electrode contact portion at least partially overlaps the second electrode contact portion in the insertion direction.

6. The card edge connector according to claim 4, wherein the surface of the end portion of the electronic substrate includes a first surface and a second surface opposite to the first surface in the height direction, the plurality of contact electrodes is located on both of the first surface and the second surface of the end portion, the plurality of first contact electrodes on the first surface is aligned with the plurality of second contact electrodes on the second surface in the insertion direction, the plurality of second contact electrodes on the first surface is aligned with the plurality of first contact electrodes on the second surface in the insertion direction, the second end of the relay terminal in contact with the contact electrode on the first surface extends over a center line from the first surface side to the second surface side before insertion of the end portion into the substrate insertion hole, and the second end of the relay terminal in contact with the contact electrode on the second surface extends over the center line from the second surface side to the first surface side before insertion of the end portion into the substrate insertion hole.

7. The card edge connector according to claim 4, wherein the surface of the end portion of the electronic substrate includes a first surface and a second surface opposite to the first surface in the height direction, the plurality of contact electrodes is located on both of the first surface and the second surface of the end portion, the housing has a housing surface defining an opening of the substrate insertion hole, each relay terminal has a terminal contact portion as the first end, an electrode contact portion as the second end, and a connecting portion that is joined between the terminal contact portion and the electrode contact portion, the terminal contact portion extends through the housing from the housing surface to a corresponding harness terminal, the connecting portion extends along the housing surface to the opening of the substrate insertion hole, the electrode contact portion projects from the opening of the substrate insertion hole into the substrate insertion hole, the electrode contact portion of one of the relay terminal in contact with the contact electrode on the first surface and the relay terminal in contact with the contact electrode on the second surface is bent in the insertion direction at a first junction between the electrode contact portion and the connecting portion of the one of the relay terminals, the electrode contact portion of the other of the relay terminal in contact with the contact electrode on the first surface and the relay terminal in contact with the contact electrode on the second surface is bent at a first position in a first direction along the insertion direction and at a second position in a second direction opposite to the first direction, the first position corresponding to a second junction between the electrode contact portion and the connecting portion of the other of the relay terminals, the electrode contact portion of the one of the relay terminals has a first straight part extending straightly from the first junction to a first contact position where the electrode contact portion is in contact with the contact electrode, the electrode contact portion of the other of the relay terminals has a second straight part extending straightly from the second position to a second contact position where the electrode contact portion is in contact with the contact electrode, and the first straight part is parallel to the second straight part.

8. The card edge connector according to claim 1, wherein the housing has a housing surface defining an opening of the substrate insertion hole, each relay terminal has a terminal contact portion as the first end, an electrode contact portion as the second end, and a connecting portion that is joined between the terminal contact portion and the electrode contact portion, the terminal contact portion extends through the housing from the housing surface to a corresponding harness terminal, the connecting portion extends along the housing surface to the opening of the substrate insertion hole, the electrode contact portion projects from the opening of the substrate insertion hole into the substrate insertion hole, and the electrode contact portion is bent at a first position in a first direction along the insertion direction and at a second position in a second direction opposite to the first direction.

9. The card edge connector according to claim 1, wherein the housing has a housing surface defining an opening of the substrate insertion hole, each relay terminal has a terminal contact portion as the first end, an electrode contact portion as the second end, and a connecting portion that is joined between the terminal contact portion and the electrode contact portion, the terminal contact portion extends through the housing from the housing surface to a corresponding harness terminal, the connecting portion extends along the housing surface to the opening of the substrate insertion hole, the electrode contact portion projects from the opening of the substrate insertion hole into the substrate insertion hole, the housing further defines a projection on an inner surface of the substrate insertion hole, the projection supports the electrode contact portion so that an angle formed by the connecting portion and the electrode contact portion is kept constant after insertion of the end portion into the substrate insertion hole, and the angle produces a contact pressure that allows the electrode contact portion to be in contact which the contact electrode.

10. A method of manufacturing the card edge connector of claim 1, wherein preparing the housing, the housing formed by resin injection molding and having the substrate insertion hole on a housing surface, a plurality of harness terminal holes, and a plurality of relay terminal holes, each relay terminal hole extending from the housing surface to a corresponding harness terminal hole;

inserting the first end of each relay terminal into a corresponding relay terminal hole in such a manner that a first part of the first end of each relay terminal is located in the corresponding harness terminal, a second part of the first end of each relay terminal is located in the relay terminal hole, a middle part between the first end and the second end of each relay terminal is located on the housing surface, and the second end of each relay terminal projects into the substrate insertion hole; and inserting each harness terminal into the corresponding harness terminal hole.

11. The method according to claim 10, wherein the inserting of the first end further includes applying pressure to a tab on the middle part, the inserting of the first end further including removing the tab after the inserting of the first end.

12. The method according to claim 10, wherein the inserting of the first end further includes fitting a tapered barb on the second part of the first end with a projection on an inner surface of the relay terminal hole.

13. A method of manufacturing the card edge connector of claim 1, wherein preparing the housing, the housing formed by resin injection molding so that the plurality of relay terminals is insert-molded, the housing having the substrate insertion hole and a plurality of harness terminal holes; and inserting each harness terminal into a corresponding harness terminal hole.

14. The method according to claim 13, further comprising placing a sealing member including a plurality of sealing portions joined together on the housing in such a manner that each sealing portion is located around an opening of the corresponding harness terminal hole, wherein the inserting of each harness terminal further includes inserting each harness terminal through the sealing member and causing a contact in a tubular body of each harness terminal to be deformed to be in contact with the first end of the corresponding relay terminal at a predetermined pressure.

15. The card edge connector according to claim 1, wherein each of the plurality of harness terminals has the same structure.

16. A card edge connector adapted to receive an electronic substrate, the electronic substrate including a plurality of contact electrodes on a surface of an end portion of the electronic substrate, the plurality of contact electrodes including a first contact electrode and a second contact electrode, the first contact electrode located in front of the second contact electrode in an insertion direction in which the end portion of the electronic substrate is adapted to be inserted into the card edge connector, the card edge connector comprising:

a housing defining an substrate insertion hole for receiving the end portion of the electronic substrate;

a plurality of harness terminals located in the housing and including a first harness terminal located in a first distance from the surface of the end portion of the electronic substrate in a height direction perpendicular to the surface after insertion of the end portion into the substrate insertion hole, the plurality of harness terminals further including a second harness terminal located in a second distance from the surface of the end portion in the height direction after insertion of the end portion into the substrate insertion hole, the second distance greater than the first distance;

a plurality of relay terminals located in the housing, each relay terminal having a first end in contact with a corresponding harness terminal and a second end in contact with a corresponding contact electrode after insertion of the end portion into the substrate insertion hole, the plurality of relay terminals including a first relay terminal electrically connecting the first harness terminal to one of the first contact electrode and the second contact electrode after insertion of the end portion into the substrate insertion hole, the plurality of relay terminals further including a second relay terminal electrically connecting the second harness terminal to the other of the first contact electrode and the second contact electrode after insertion of the end portion into the substrate insertion hole; and a plurality of harnesses, each harness having a third end connected to a corresponding harness terminal and a fourth end exposed outside the housing, the plurality of harnesses including a first harness connected to the first harness terminal and a second harness connected to the second harness terminal, wherein the first contact electrode comprises a plurality of first contact electrodes that are aligned with each other on the surface of the end portion in a lateral direction perpendicular to each of the insertion direction and the height direction, the second contact electrode comprises a plurality of second contact electrodes that are aligned with each other on the surface of the end portion in the lateral direction, the plurality of first contact electrodes is not aligned with the plurality of second contact electrodes in the insertion direction, the surface of the end portion of the electronic substrate includes a first surface and a second surface opposite to the first surface in the height direction, the plurality of contact electrodes is located on both of the first surface and the second surface of the end portion, the plurality of first contact electrodes on the first surface is aligned with the plurality of second contact electrodes on the second surface in the insertion direction, the plurality of second contact electrodes on the first surface is aligned with the plurality of first contact electrodes on the second surface in the insertion direction, the second end of the relay terminal in contact with the contact electrode on the first surface extends over a center line from the first surface side to the second surface side before insertion of the end portion into the substrate insertion hole, and the second end of the relay terminal in contact with the contact electrode on the second surface extends over the center line from the second surface side to the first surface side before insertion of the end portion into the substrate insertion hole.

17. A card edge connector adapted to receive an electronic substrate, the electronic substrate including a plurality of contact electrodes on a surface of an end portion of the electronic substrate, the plurality of contact electrodes including a first contact electrode and a second contact electrode, the first contact electrode located in front of the second contact electrode in an insertion direction in which the end portion of the electronic substrate is adapted to be inserted into the card edge connector, the card edge connector comprising:

a housing defining an substrate insertion hole for receiving the end portion of the electronic substrate;

a plurality of harness terminals located in the housing and including a first harness terminal located in a first distance from the surface of the end portion of the electronic substrate in a height direction perpendicular to the surface after insertion of the end portion into the substrate insertion hole, the plurality of harness terminals further including a second harness terminal located in a second distance from the surface of the end portion in the height direction after insertion of the end portion into the substrate insertion hole, the second distance greater than the first distance;

a plurality of relay terminals located in the housing, each relay terminal having a first end in contact with a corresponding harness terminal and a second end in contact with a corresponding contact electrode after insertion of the end portion into the substrate insertion hole, the plurality of relay terminals including a first relay terminal electrically connecting the first harness terminal to one of the first contact electrode and the second contact electrode after insertion of the end portion into the substrate insertion hole, the plurality of relay terminals further including a second relay terminal electrically connecting the second harness terminal to the other of the first contact electrode and the second contact electrode after insertion of the end portion into the substrate insertion hole; and a plurality of harnesses, each harness having a third end connected to a corresponding harness terminal and a fourth end exposed outside the housing, the plurality of harnesses including a first harness connected to the first harness terminal and a second harness connected to the second harness terminal, wherein the housing has a housing surface defining an opening of the substrate insertion hole, each relay terminal has a terminal contact portion as the first end, an electrode contact portion as the second end, and a connecting portion that is joined between the terminal contact portion and the electrode contact portion, the terminal contact portion extends through the housing from the housing surface to a corresponding harness terminal, the connecting portion extends along the housing surface to the opening of the substrate insertion hole, the electrode contact portion projects from the opening of the substrate insertion hole into the substrate insertion hole, and the electrode contact portion is bent at a first position in a first direction along the insertion direction and at a second position in a second direction opposite to the first direction.

18. A card edge connector adapted to receive an electronic substrate, the electronic substrate including a plurality of contact electrodes on a surface of an end portion of the electronic substrate, the plurality of contact electrodes including a first contact electrode and a second contact electrode, the first contact electrode located in front of the second contact electrode in an insertion direction in which the end portion of the electronic substrate is adapted to be inserted into the card edge connector, the card edge connector comprising:

a housing defining an substrate insertion hole for receiving the end portion of the electronic substrate;

a plurality of harness terminals located in the housing and including a first harness terminal located in a first distance from the surface of the end portion of the electronic substrate in a height direction perpendicular to the surface after insertion of the end portion into the substrate insertion hole, the plurality of harness terminals further including a second harness terminal located in a second distance from the surface of the end portion in the height direction after insertion of the end portion into the substrate insertion hole, the second distance greater than the first distance;

a plurality of relay terminals located in the housing, each relay terminal having a first end in contact with a corresponding harness terminal and a second end in contact with a corresponding contact electrode after insertion of the end portion into the substrate insertion hole, the plurality of relay terminals including a first relay terminal electrically connecting the first harness terminal to one of the first contact electrode and the second contact electrode after insertion of the end portion into the substrate insertion hole, the plurality of relay terminals further including a second relay terminal electrically connecting the second harness terminal to the other of the first contact electrode and the second contact electrode after insertion of the end portion into the substrate insertion hole; and a plurality of harnesses, each harness having a third end connected to a corresponding harness terminal and a fourth end exposed outside the housing, the plurality of harnesses including a first harness connected to the first harness terminal and a second harness connected to the second harness terminal, wherein the first contact electrode comprises a plurality of first contact electrodes that are aligned with each other on the surface of the end portion in a lateral direction perpendicular to each of the insertion direction and the height direction, the second contact electrode comprises a plurality of second contact electrodes that are aligned with each other on the surface of the end portion in the lateral direction, the plurality of first contact electrodes is not aligned with the plurality of second contact electrodes in the insertion direction, the surface of the end portion of the electronic substrate includes a first surface and a second surface opposite to the first surface in the height direction, the plurality of contact electrodes is located on both of the first surface and the second surface of the end portion, the housing has a housing surface defining an opening of the substrate insertion hole, each relay terminal has a terminal contact portion as the first end, an electrode contact portion as the second end, and a connecting portion that is joined between the terminal contact portion and the electrode contact portion, the terminal contact portion extends through the housing from the housing surface to a corresponding harness terminal, the connecting portion extends along the housing surface to the opening of the substrate insertion hole, the electrode contact portion projects from the opening of the substrate insertion hole into the substrate insertion hole, the electrode contact portion of one of the relay terminal in contact with the contact electrode on the first surface and the relay terminal in contact with the contact electrode on the second surface is bent in the insertion direction at a first junction between the electrode contact portion and the connecting portion of the one of the relay terminals, the electrode contact portion of the other of the relay terminal in contact with the contact electrode on the first surface and the relay terminal in contact with the contact electrode on the second surface is bent at a first position in a first direction along the insertion direction and at a second position in a second direction opposite to the first direction, the first position corresponding to a second junction between the electrode contact portion and the connecting portion of the other of the relay terminals, the electrode contact portion of the one of the relay terminals has a first straight part extending straightly from the first junction to a first contact position where the electrode contact portion is in contact with the contact electrode, the electrode contact portion of the other of the relay terminals has a second straight part extending straightly from the second position to a second contact position where the electrode contact portion is in contact with the contact electrode, and the first straight part is parallel to the second straight part.

19. A card edge connector adapted to receive an electronic substrate, the electronic substrate including a plurality of contact electrodes on a surface of an end portion of the electronic substrate, the plurality of contact electrodes including a first contact electrode and a second contact electrode, the first contact electrode located in front of the second contact electrode in an insertion direction in which the end portion of the electronic substrate is adapted to be inserted into the card edge connector, the card edge connector comprising:

a housing defining an substrate insertion hole for receiving the end portion of the electronic substrate;

a plurality of harness terminals located in the housing and including a first harness terminal located in a first distance from the surface of the end portion of the electronic substrate in a height direction perpendicular to the surface after insertion of the end portion into the substrate insertion hole, the plurality of harness terminals further including a second harness terminal located in a second distance from the surface of the end portion in the height direction after insertion of the end portion into the substrate insertion hole, the second distance greater than the first distance;

a plurality of relay terminals located in the housing, each relay terminal having a first end in contact with a corresponding harness terminal and a second end in contact with a corresponding contact electrode after insertion of the end portion into the substrate insertion hole, the plurality of relay terminals including a first relay terminal electrically connecting the first harness terminal to one of the first contact electrode and the second contact electrode after insertion of the end portion into the substrate insertion hole, the plurality of relay terminals further including a second relay terminal electrically connecting the second harness terminal to the other of the first contact electrode and the second contact electrode after insertion of the end portion into the substrate insertion hole; and a plurality of harnesses, each harness having a third end connected to a corresponding harness terminal and a fourth end exposed outside the housing, the plurality of harnesses including a first harness connected to the first harness terminal and a second harness connected to the second harness terminal, wherein the housing has a housing surface defining an opening of the substrate insertion hole, each relay terminal has a terminal contact portion as the first end, an electrode contact portion as the second end, and a connecting portion that is joined between the terminal contact portion and the electrode contact portion, the terminal contact portion extends through the housing from the housing surface to a corresponding harness terminal, the connecting portion extends along the housing surface to the opening of the substrate insertion hole, the electrode contact portion projects from the opening of the substrate insertion hole into the substrate insertion hole, the housing further defines a projection on an inner surface of the substrate insertion hole, the projection supports the electrode contact portion so that an angle formed by the connecting portion and the electrode contact portion is kept constant after insertion of the end portion into the substrate insertion hole, and the angle produces a contact pressure that allows the electrode contact portion to be in contact which the contact electrode.

* * * * *